US009105264B2

(12) United States Patent
Ishikawa et al.

(10) Patent No.: US 9,105,264 B2
(45) Date of Patent: Aug. 11, 2015

(54) CODING APPARATUS AND DECODING APPARATUS

(75) Inventors: Tomokazu Ishikawa, Osaka (JP); Takeshi Norimatsu, Hyogo (JP); Kok Seng Chong, Singapore (SG); Huan Zhou, Singapore (SG)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 1168 days.

(21) Appl. No.: 13/121,991

(22) PCT Filed: Jul. 30, 2010

(86) PCT No.: PCT/JP2010/004827

§ 371 (c)(1),
(2), (4) Date: Mar. 31, 2011

(87) PCT Pub. No.: WO2011/013381

PCT Pub. Date: Feb. 3, 2011

(65) Prior Publication Data

US 2011/0182432 A1 Jul. 28, 2011

(30) Foreign Application Priority Data

Jul. 31, 2009 (JP) ..... 2009-180030

(51) Int. Cl.
*H04R 5/00* (2006.01)
*G10L 19/008* (2013.01)

(52) U.S. Cl.
CPC ..... *G10L 19/008* (2013.01); *H04S 2420/03* (2013.01)

(58) Field of Classification Search
USPC ..... 381/22, 23
See application file for complete search history.

(56) References Cited

U.S. PATENT DOCUMENTS 7,573,912 B2 8/2009 Lindblom
2005/0149322 A1 7/2005 Bruhn et al.

(Continued)

FOREIGN PATENT DOCUMENTS

CN 101120615 2/2008
JP 2006-259291 9/2006

(Continued)

OTHER PUBLICATIONS

Jurgen Herre et al., MPEG Surround—The ISO/MPEG Standard for Efficient and Compatible Multichannel Audio Coding, Journal of the AES, USA, AES, Nov. 2008, vol. 56, No. 11, pp. 932-955.

(Continued)

*Primary Examiner* — Duc Nguyen
*Assistant Examiner* — Phan Le
(74) *Attorney, Agent, or Firm* — Wenderoth, Lind & Ponack, L.L.P.

(57) ABSTRACT

A coding apparatus which suppresses an extreme increase in a bit rate, includes: a downmixing and coding unit (301) that downmixes audio signals that have been provided, to reduce the number of channels to be fewer than the number of the provided audio signals, and to code the downmix signals; an object parameter extracting unit (304) that extracts parameters indicating correlation between the audio signals; and a multiplexing circuit (309) that multiplexes the extracted parameters with the generated downmix coded signals. The object parameter extracting unit (304) includes: an object classifying unit (305) that classifies each of the provided audio signals into a predetermined one of types based on audio characteristics; and an object parameter extracting circuit (308) that extracts parameters using a temporal granularity and a frequency granularity each of which is determined for a corresponding one of the types.

15 Claims, 13 Drawing Sheets

(56) References Cited

U.S. PATENT DOCUMENTS

| | | | | |
|---|---|---|---|---|
| 2006/0190247 | A1 | 8/2006 | Lindblom | |
| 2006/0233379 | A1 * | 10/2006 | Villemoes et al. | 381/23 |
| 2007/0067166 | A1 | 3/2007 | Pan et al. | |
| 2007/0140499 | A1 * | 6/2007 | Davis | 381/23 |
| 2008/0008323 | A1 * | 1/2008 | Hilpert et al. | 381/1 |
| 2008/0031463 | A1 | 2/2008 | Davis | |
| 2008/0097751 | A1 * | 4/2008 | Tsuchinaga et al. | 704/205 |

FOREIGN PATENT DOCUMENTS

| | | |
|---|---|---|
| JP | 2006-267943 | 10/2006 |
| JP | 2007-506986 | 3/2007 |
| JP | 2008-26372 | 2/2008 |
| JP | 2008-26914 | 2/2008 |
| WO | 2005/027094 | 3/2005 |
| WO | 2005/086139 | 9/2005 |
| WO | 2008/003362 | 1/2008 |

OTHER PUBLICATIONS

J. Herre et al., The Reference Model Architecture for MPEG Spatial Audio Coding, Proc. 118th AES Convention, AES, May 28, 2005, pp. 1-13.

Extended European Search Report issued Apr. 8, 2014 in corresponding European patent application No. 10804132.8.

Oliver Helmuth, et al., "MPEG Spatial Audio Object Coding the ISO/MPEG Standard for Efficient Coding of Interactive Audio Scenes", AES Convention 129; Nov. 2010, AES, 60 East 42nd Street, Room 2520, New York 10165-2520, USA, Nov. 4, 2010, XP040567234.

Jürgen Herre et al., "MPEG Surround the ISO/MPEG Standard for Efficient and Compatible Multi-Channel Audio Coding", Audio Engineering Society Convention Paper, New York, NY, US, vol. 122, May 8, 2007, pp. 1-23, XP007906004.

Breebaart Jeroen et al., "MPEG Surround ÃÂÂ the ISO/MPEG Standard for Efficient and Compatible Multi-Channel Audio Coding", AES Convention 122; May 2007, AES, 60 East 42nd Street, Room 2520, New York 10165-2520, USA, May 8, 2007, XP040508156.

International Search Report issued Nov. 2, 2010 in International (PCT) Application No. PCT/JP2010/004827.

Takeshi Norimatsu, "*Very-low-bitrate, high-quality multi-channel audio coding technology MPEG surround*", Panasonic Technical Journal, vol. 54, No. 4, Jan. 2009, pp. 55-59.

Jonas Engdegard et al., Audio Engineering Society Convention Paper 7377 "*Spatial Audio Object Coding (SAOC)—The Upcoming MPEG Standard on Parametric Object Based Audio Coding*", Presented at the 124th Convention May 17-20, 2008 Amsterdam, The Netherlands.

Jurgen Herre et al., Audio Engineering Society Convention Paper 7084 "*MPEG Surround—The ISO/MPEG Standard for Efficient and Compatible Multi-Channel Audio Coding*" Presented at the 122nd Convention May 5-8, 2007 Vienna, Austria.

* cited by examiner

CODING APPARATUS AND DECODING APPARATUS

TECHNICAL FIELD

The present invention relates to coding apparatuses and decoding apparatuses, and in particular to a coding apparatus that codes an audio object signal and a decoding apparatus that decodes the audio object signal.

BACKGROUND ART

As a method of coding an audio signal, a known typical method is, for example, a method of coding an audio signal by performing frame processing on the audio signal, using time segmentation with a temporally predetermined sample. In addition, the audio signal that is coded as described above and transmitted is decoded afterwards, and the decoded audio signal is reproduced by an audio reproduction system such as an earphone and speaker, or a reproduction apparatus.

In recent years, technologies for enhancing convenience for a user of a reproduction apparatus by mixing a decoded audio signal with an external audio signal, or by performing rendering so as to reproduce a decoded audio signal from an arbitrary position such as up, down, left and right. With this technology, at a remote conference conducted via a network, for example, a participant at a certain location can independently adjust spatial arrangement or volume of a sound of another participant at a different location. Furthermore, music enthusiasts can generate a remix signal of a music track interactively to enjoy music, by controlling vocal or various instrumental components of his or her favorite piece in a variety of ways, for example.

As a technology for implementing such an application, there is a parametric audio object coding technology (see PTL 1 and NPL 1, for example). For example, the Moving Picture Experts Group Spatial Audio Object Coding specification (MPEG-SAOC) which is in the process of being standardized in recent years has been developed as described in NPL 1.

Here, there is a coding technology which is similar to the SAC and is developed for the purpose of efficiently coding an audio object signal with low calculation amount, based on a parametric multi-channel coding technology (also known as Spatial Audio Coding (SAC)) represented by MPEG surround disclosed, for example, by NPL 2. With the coding technology similar to SAC, a statistical correlation between audio signals such as phase difference or level ratio between signals is calculated to be quantized and coded. This allows more efficient coding compared to the system in which audio signals are independently coded. MPEG-SAOC technology disclosed by above-described NPL 1 is obtained by extending the coding technology similar to SAC so as to be applied to audio object signals.

Assume that an audio space of a reproduction apparatus (parametric audio object decoding apparatus) in which the parametric audio object coding technology such as the MPEG-SAOC technology is used is an audio space that enables multi-channel surround reproduce of 5.1 surround sound system. In this case, in the parametric audio object decoding apparatus, a device called a transcoder converts a coded parameter based on an amount of statistics between audio object signals, using audio spatial parameters (HRTF coefficient). This makes it possible to reproduce the audio signal in an audio space arrangement suitable for an intention of a listener.

FIG. 1 is a block diagram which shows a configuration of an audio object coding apparatus 100 of a general parametric.

The audio object coding apparatus 100 shown in FIG. 1 includes: an object downmixing circuit 101; a T-F conversion circuit 102; an object parameter extracting circuit 103; and a downmix signal coding circuit 104.

The object downmixing circuit 101 is provided with audio object signals and downmixes the provided audio object signals to monaural or stereo downmix signals.

The downmix signal coding circuit 104 is provided with the downmix signals resulting from the downmixing performed by the object downmixing circuit 101. The downmix signal coding circuit 104 codes the provided downmix signals to generate a downmix bitstream. Here, in the MPEG-SAOC technology, MPEG-AAC system is used as a downmix coding system.

The T-F conversion circuit 102 is provided with audio object signals and demultiplexes the provided audio object signals to spectrum signals specified by both time and frequency.

The object parameter extracting circuit 103 is provided with the audio object signals demultiplexed to the spectrum signals by the T-F conversion circuit 102 and calculates an object parameter from the provided audio object signals demultiplexed to the spectrum signals Here, in the MPEG-SAOC technology, the object parameters (extended information) includes, for example, object level differences (OLD), object cross correlation coefficient (IOC), downmix channel level differences (DCLD), object energy (NRG), and so on.

A multiplexing circuit 105 is provided with the object parameter calculated by the object parameter extracting circuit 103 and the downmix bitstream generated by the downmix signal coding circuit 104. The multiplexing circuit 105 multiplexes and outputs the provided downmix bitstream and the object parameter to a single audio bitstream.

The audio object coding apparatus 100 is configured as described above.

FIG. 2 is a block diagram which shows a configuration of a typical audio object decoding apparatus 200. The audio object decoding apparatus 200 shown in FIG. 2 includes: an object parameter converting circuit 203; and a parametric multi-channel decoding circuit 206.

FIG. 2 shows a case where the audio object decoding apparatus 200 includes a speaker of the 5.1 surround sound system. Accordingly, two decoding circuits are connected to each other in series in the audio object decoding apparatus 200. More specifically, the object parameter converting circuit 203 and the parametric multi-channel decoding circuit 206 are connected to each other in series. In addition, a demultiplexing circuit 201 and a downmix signal decoding circuit 210 are provided in a stage prior to the audio object decoding apparatus 200, as shown in FIG. 2.

The demultiplexing circuit 201 is provided with the object stream, that is, an audio object coded signal, and demultiplexes the provided audio object coded signal to a downmix coded signal and object parameters (extended information). The demultiplexing circuit 201 outputs the downmix coded signal and the object parameters (extended information) to the downmix signal decoding circuit 210 and the object parameter converting circuit 203, respectively.

The downmix signal decoding circuit 210 decodes the provided downmix coded signal to a downmix decoded signal and outputs the decoded signal to the object parameter converting circuit 203.

The object parameter converting circuit 203 includes a downmix signal preprocessing circuit 204 and an object parameter arithmetic circuit 205.

The downmix signal preprocessing circuit 204 generates a new downmix signal based on characteristics of spatial prediction parameters included in MPEG surround coding information. More specifically, the downmix decoded signal outputted from the downmix signal decoding circuit 210 to the object parameter converting circuit 203 is provided. The downmix signal preprocessing circuit 204 generates a preprocessed downmix signal based on the provided downmix decoded signal. At this time, the downmix signal preprocessing circuit 204 generates, at the end, a preprocessed downmix signal according to arrangement information (rendering information) and information included in the object parameters which are included in the demultiplexed audio object signal. Then, the downmix signal preprocessing circuit 204 outputs the generated preprocessed downmix signal to the parametric multi-channel decoding circuit 206.

The object parameter arithmetic circuit 205 converts the object parameters to spatial parameters that correspond to Spatial Cue of MPEG surround system. More specifically, the object parameters (extended information) outputted from the demultiplexing circuit 201 to the object parameter converting circuit 203 is provided to the object parameter arithmetic circuit 205. The object parameter arithmetic circuit 205 converts the provided object parameters to audio spatial parameters and outputs the converted parameters to the parametric multi-channel decoding circuit 206. Here, the audio spatial parameters correspond to audio spatial parameters of SAC coding system described above.

The parametric multi-channel decoding circuit 206 is provided with the preprocessed downmix signal and the audio spatial parameters, and generates audio signals based on the provided preprocessed downmix signal and audio spatial parameters.

The parametric multi-channel decoding circuit 206 includes: a domain converting circuit 207; a multi-channel signal synthesizing circuit 208; and an F-T converting circuit 209.

The domain converting circuit 207 converts the preprocessed downmix signal provided to the parametric multi-channel decoding circuit 206, into a synthesized spatial signal.

The multi-channel signal synthesizing circuit 208 converts the synthesized spatial signal converted by the domain converting circuit 207, into a multi-channel spectrum signal based on the audio spatial parameter provided by the object parameter arithmetic circuit 205.

The F-T converting circuit 209 converts the multi-channel spectrum signal converted by the multi-channel signal synthesizing circuit 208, into an audio signal of multi-channel temporal domain and outputs the converted audio signal.

The audio object decoding apparatus 200 is configured as described above.

It is to be noted that, the audio object coding method described above shows two functions as below. One is a function which realizes high compression efficiency not by independently coding all of the objects to be transmitted, but by transmitting the downmix signal and small object parameters. The other is a function of resynthesizing which allows real-time change of the audio space on a reproduction side, by processing the object parameters in real time based on the rendering information.

In addition, with the audio object coding method described above, the object parameters (extended information) are calculated for each cell segmented by time and frequency (the width of the cell is called temporal granularity and frequency granularity). A time division for calculating object parameters is adaptively determined according to transmission granularity of the object parameters. It is necessary to code the object parameters more efficiently in view of the balance between a frequency resolution and a temporal resolution with a low bit rate, compared to the case with a high bit rate.

In addition, the frequency resolution used in the audio object coding technology is segmented based on the knowledge of auditory perception characteristics of human. On the other hand, the temporal resolution used in the audio object coding technology is determined by detecting a significant change in the information of object parameters in each frame. As a referential one for each temporal segment, for example, one temporal segment is provided for each frame segment. When the referential segment is applied, the same object parameters are transmitted in the frame with the time length of the frame.

As described above, in order to obtain high coding efficiency on the side of a coding apparatus for audio object coding, the temporal resolution and the frequency resolution of each of the object parameters are adaptively controlled in many cases. In such adaptive control, the temporal resolution and the frequency resolution are generally changed according to complexity of information indicating audio signal of a downmix signal, characteristics of each object signal, and requested bit rate, as needed. FIG. 3 shows an example for this.

FIG. 3 shows a relationship between a temporal segment and a subband, a parameter set, and a parameter band. As shown in FIG. 3, a spectrum signal included in one frame is segmented into N temporal segments and k frequency segments.

In the mean time, with the MPEG-SAOC technology disclosed by above-described NPL 1, each frame includes a maximum of eight temporal segments according to the specification. In addition, when smaller temporal segment and frequency segment are applied, the audio quality after coding or distinction between sounds of each of the object signals naturally improves; however, the amount of information to be transmitted increases as well, resulting in the increase in the bit rate. As described above, there is a trade-off between the bit rate and the audio quality.

Thus, there is a method of temporal segment that is experimentally shown. To be specific, in order to assign an appropriate bit rate to an object parameter, at least one additional temporal segment is set so that one frame is segmented into one or two regions. Such a limitation enables an appropriate balance between the audio quality and the bit rate assigned to the object parameter. As to 0 or 1 additional segment, for example, the requested bit rate to the object parameter is approximately 3 kbps per an object, resulting in an additional overhead of 3 kbps per one scene. Thus, it is apparent that, in proportion to the increase in the number of objects, the parametric object coding method is more efficient than a general object coding method conventionally carried out.

As described above, it is possible to achieve an excellent audio quality with the object coding of high bit efficiency, by using the aforementioned temporal segment. However, it is not possible to always provide all of essential applications with coded audio with sufficient quality. In view of the above, a residual coding technique is introduced to the parametric coding technology so that a gap between the audio quality of the parametric object coding and a transparent audio quality.

In the general residual coding technique, a residual signal is related to a portion other than a main part of a downmix signal, in most cases. For simplification here, the residual signal is assumed to be a difference between two downmix signals. In addition, it is assumed that a frequency component with a low residual signal is transmitted so as to reduce a bit rate. In such a case, a frequency band of a residual signal is set on the side of the coding apparatus, and a trade-off between a consumed bit rate and reproduction quality is adjusted.

On the other hand, with the MPEG-SAOC technology, it is only necessary to hold a frequency band of 2 kHz as a useful residual signal, and the audio quality is clearly improved by performing coding with 8 kbps per one residual signal. Thus, for an object signal to which a high audio quality is required, the bit rate of 3+8=11 kbps per one object is assigned to an object parameter. Accordingly, it is considered that a requested bit rate becomes extremely high with plenty of width, when the application requires a high quality multi-object.

CITATION LIST

Patent Literature

[PTL 1]
WO 2008/003362

Non Patent Literature

[NPL 1]
Audio Engineering Society Convention Paper 7377 "Spatial Audio Object Coding (SAOC)—The Upcoming MPEG Standard on Parametric Object Based Audio Coding"
[NPL 2]
Audio Engineering Society Convention Paper 7084 "MPEG Surround—The ISO/MPEG Standard for Efficient and Compatible Multi-Channel Audio Coding"

SUMMARY OF INVENTION

Technical Problem

As described above, in order to improve reproducibility of sound field by increasing the coding efficiency and the distinction between sounds of each of the object signals, the audio object coding technique is used in many application scenarios.

However, with the residual coding system according to the aforementioned conventional configuration, a bit rate extremely increases in some cases when a high level audio quality of an object is required.

Thus, the present invention has been conceived to solve the above-described problems and aims to provide a coding apparatus and a decoding apparatus which suppress an extreme increase in a bit rate.

Solution to Problem

In order to solve the above described problem, a coding apparatus of an aspect of the present invention includes: a downmixing and coding unit configured to downmix audio signals that have been provided, into audio signals having the number of channels fewer than the number of the provided audio signals, and to code the downmix signals; a parameter extracting unit configured to extract, from the provided audio signals, parameters indicating correlation between the audio signals; and a multiplexing circuit which multiplexes the parameters extracted by the parameter extracting unit with downmix coded signals generated by the downmixing and coding unit, wherein the parameter extracting unit includes: a classifying unit configured to classify each of the provided audio signals into a corresponding one of predetermined types, based on audio characteristics of each of the audio signals; and an extracting unit configured to extract the parameters from each of the audio signals classified by the classifying unit, using a temporal granularity and a frequency granularity which are determined for a corresponding one of the types.

With the above-described configuration, it is possible to implement a coding apparatus that suppresses an extreme increase in a bit rate.

Furthermore, the classifying unit may determine the audio characteristics of the provided audio signals, using transient information indicating transient characteristics of the provided audio signals and tonality information indicating an intensity of a tone component included in the provided audio signals.

Furthermore, the classifying unit may classify at least one of the provided audio signals, into a first type that includes: a first temporal segment as the predetermined temporal granularity; and a first frequency segment as the predetermined frequency granularity.

Furthermore, the classifying unit may classify the provided audio signals, into the first type or other types different from the first type, by comparing the transient information that indicates the transient characteristics of the provided audio signals with the transient information of at least one of the audio signals that belongs to the first type.

Furthermore, the classifying unit may classify each of the provided audio signals into one of the first type, a second type, a third type, and a fourth type, according to the audio characteristics of each of the audio signals, the second type including at least one temporal segment or frequency segment more than the first type, the third type including the temporal segment having the same number as and different in position from the first type, and the fourth type where the first type includes one temporal segment but the provided audio signals does not include a temporal segment or the first type does not include a temporal segment but the provided audio signals include two temporal segments.

Furthermore, the parameter extracting unit may code the parameters extracted by the extracting unit, the multiplexing circuit may multiplex the parameters coded by the parameter extracting unit, with the downmix coded signal, and the parameter extracting circuit, when the parameters extracted from the audio signals classified into the same type by the classifying unit have the same number of segments, may further perform coding by setting only one of the parameters extracted from the audio signals as the number of segments common to the audio signals classified into the same type.

Furthermore, the classifying unit may determine a segment position of each of the provided audio signals, based on the tonality information indicating the intensity of the tone component included as the audio characteristics in each of the provided audio signals, and may classify each of the provided audio signals into a corresponding one of the predetermined types, according to the determined segment position.

In order to solve the above described problem, a decoding apparatus of an aspect of the present invention is a decoding apparatus which performs parametric multi-channel decoding and includes: a demultiplexing unit configured to receive audio coded signals and to demultiplex the audio coded signals into downmix coded information and parameters, the audio coded signals including the downmix coded information and the parameters, the downmix coded information obtained by downmixing and coding audio signals, and the parameters indicating correlation between the audio signals; a downmix decoding unit configured to decode the downmix coded information to obtain audio downmix signals, the downmix coded information demultiplexed by the demultiplexing unit; an object decoding unit configured to convert the parameters demultiplexed by the demultiplexing unit, into spatial parameters for demultiplexing the audio downmix signals into audio signals; and a decoding unit configured to perform parametric multi-channel decoding on the audio downmix signals, into the audio signals, using the spatial parameters converted by the object decoding unit, wherein the object decoding unit includes: a classifying unit configured to classify each of the parameters demultiplexed by the demultiplexing unit, into a corresponding one of predetermined types; and an arithmetic unit configured to convert each of the parameters classified by the classifying unit, into a corresponding one of the spatial parameters classified into the types.

With the above-described configuration, it is possible to implement a decoding apparatus that suppresses an extreme increase in a bit rate. Furthermore, the decoding apparatus may further include a preprocessing unit configured to preprocess the downmix coded information, the preprocessing unit provided in a stage prior to the decoding unit, wherein the arithmetic unit is configured to convert each of the parameters classified by the classifying unit, into a corresponding one of the spatial parameters classified into the types, based on spatial arrangement information classified based on the predetermined types, and the preprocessing unit is configured to preprocess the downmix coded information based on each of the classified parameters and the classified spatial arrangement information.

Furthermore, the spatial arrangement information may indicate information on a spatial arrangement of the audio signals and may be associated with the audio signals, and the spatial arrangement information classified based on the predetermined types may be associated with the audio signals classified into the predetermined types.

Furthermore, the decoding unit may include: a synthesizing unit configured to synthesize the audio downmix signals into spectrum signal sequences classified into the types, according to the spatial parameters classified into the types; a combining unit configured to combine the classified spectrum signals into a single spectrum signal sequence; and a converting unit configured to convert the spectrum signal sequence, into audio signals, the spectrum signal sequence obtained by combining the classified spectrum signals.

Furthermore, the decoding apparatus may include: an audio signal synthesizing unit configured to synthesize multi-channel output spectrums from the provided audio downmix signals, wherein said audio signal synthesizing unit may include: a preprocess sequence arithmetic unit configured to correct a the factor of the provided audio downmix signals, a preprocess multiplying unit configured to linearly interpolate the spatial parameters classified into the types and to output the linearly interpolated spatial parameters to said preprocess sequence arithmetic unit; a reverberation generating unit configured to perform a reverberation signal adding process on a part of the audio downmix signals whose the factor is corrected by said preprocess sequence arithmetic unit; and a postprocess sequence arithmetic unit configured to generate the multi-channel output spectrums using a predetermined sequence, from the part of the audio downmix signals which is corrected and on which reverberation signal adding process is performed by said reverberation generating unit and a rest of the corrected audio downmix signals provided from said preprocess sequence arithmetic unit.

It should be noted that the present invention can be implemented, in addition to implementation as an apparatus, as an integrated circuit including processing units that the apparatus includes, as a method including processing units included in the apparatus as steps, as a program which, when loaded into a computer, allows a computer to execute the steps, and information, data and a signal which represent the program. Further, the program, the information, the data and the signal may be distributed via recording medium such as a CD-ROM and communication medium such as the Internet.

[Advantageous Effects of Invention]

According to the present invention, it is possible to implement a coding apparatus and a decoding apparatus which suppress an extreme increase in a bit rate. For example, it is possible to improve the bit efficiency of coded information generated by the coding apparatus, and to improve the audio quality of a decoded signal obtained through decoding performed by the decoding apparatus.

DESCRIPTION OF EMBODIMENTS

Embodiments described below are not limitations, but examples of an as embodiment of the present invention. In addition, the present embodiment is based on a latest audio object coding technology (MPEG-SAOC); however, the invention is not limited to the embodiment, and contributes to improving audio quality of general parametric audio object coding technology.

In general, the temporal segment for coding an audio object signal is adaptively changed triggered by a transitional change such as increase in the number of objects, a sudden rise of an object signal, or sudden change in audio characteristics. In addition, audio object signals with different audio characteristics are coded with different temporal segments in most cases, as in the case where the object signal to be coded is, for example, a signal of vocal and background music. Thus, in a parametric object coding technology such as MPEG-SAOC, it is difficult, at the time of coding audio object signals, to perform object coding with high audio quality to which characteristics of all of the audio object signals are reflected, by merely setting the number of a usual temporal segment as zero, or by merely adding one temporal segment to the number of the usual temporal segment, as in the conventional techniques. On the other hand, when plural (many) temporal segments are set and all of the audio object signals are captured, a bit rate assigned to object parameter information significantly increases.

In view of the facts described above, it is significantly important to appropriately balance a bit rate with audio quality.

Therefore, according to the present invention, coding efficiency is improved by classifying audio object signals that are target of coding, into several classes (types) that have been determined in advance according to signal characteristics (audio characteristics). More specifically, the temporal segment when performing audio object coding is adaptively changed according to audio characteristics of audio signals that have been provided. In other words, the temporal segments (temporal resolution) for calculating object parameters (extended information) of audio object coding is selected according to the characteristics of audio object signals that have been provided.

Details for the above will be described in embodiments of the present invention below.

Embodiment 1

First, descriptions for a coding apparatus will be given.

Figure 4:
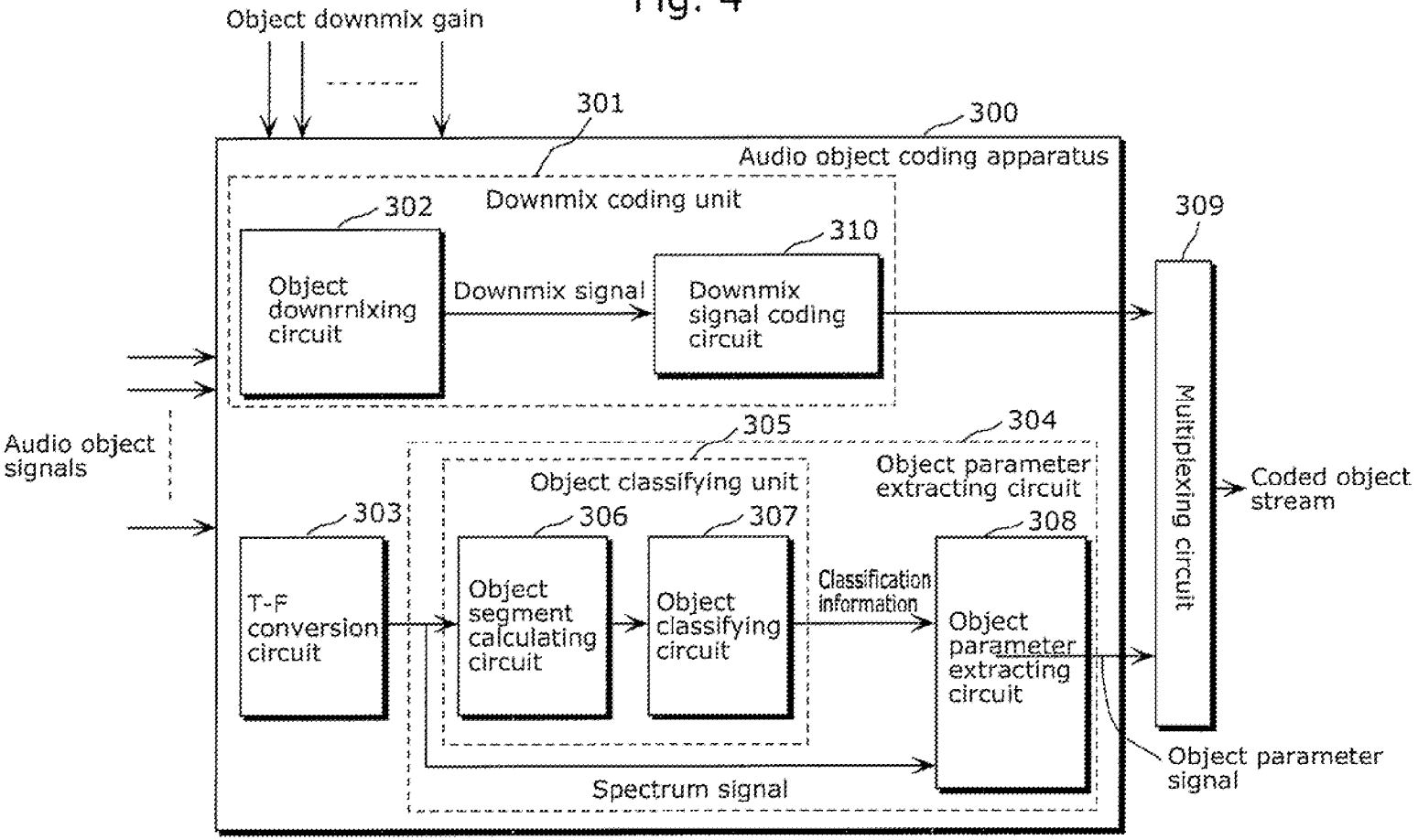
FIG. 4 is a block diagram which shows an example of a a configuration of an audio object coding apparatus according to the present invention.

FIG. 4 is a block diagram which shows an example of a configuration of an audio object coding apparatus according to the present invention.

An audio object coding apparatus 300 shown in FIG. 4 includes: a downmixing and coding unit 301; a T-F conversion circuit 303; and an object parameter extracting unit 304. In addition, the audio object coding apparatus 300 includes a multiplexing circuit 309 in a subsequent stage.

The downmixing and coding unit 301 includes an object downmixing circuit 302 and a downmix signal coding circuit 310, downmixes provided audio object signals to reduce the number of channels, and codes the downmixed audio object signals.

More specifically, the object downmixing circuit 302 is provided with audio object signals and downmixes the provided audio object signals so as to be downmix signals which have the lower number of channels than the number of channels of the provided audio object signals, such as monaural or stereo downmix signals. The downmix signal coding circuit 310 is provided with the downmix signals resulting from the downmixing performed by the object downmixing circuit 302. The downmix signal coding circuit 310 codes the provided downmix signals to generate a downmix bitstream. Here, MPEG-AAC system, for example, is used as a downmix coding system.

The T-F conversion circuit 303 is provided with audio object signals and converts the provided audio object signals into spectrum signals specified by both time and frequency. For example, the T-F conversion circuit 303 converts the provided audio object signals into signals in a temporal and a frequency domain, using a QMF filter bank or the like. Then, the T-F conversion circuit 303 outputs the audio object signals demultiplexed into spectrum signals, to the object parameter extracting unit 304.

The object parameter extracting unit 304 includes: an object classifying unit 305; and an object parameter extracting circuit 308, and extracts, from the provided audio object signals, parameters that indicate an audio correlation between the audio object signals. More specifically, the object parameter extracting unit 304 calculates (extracts), from the audio object signals converted into the spectrum signals provided by the T-F conversion circuit 303, object parameters (extended information) that indicate a correlation between the audio object signals.

To be further specific, the object classifying unit 305 includes: an object segment calculating circuit 306; and an object classifying circuit 307, and classifies the provided audio object signals respectively into predetermined types, based on the audio characteristics of the audio object signals.

To be yet further specific, the object segment calculating circuit 306 calculates object segment information that indicates a segment position of each of the audio signals, base on the audio characteristics of the audio object signals. It is to be noted that the object segment calculating circuit 306 may determine the audio characteristics of the audio object signals to decide the object segment information, using transient information that indicates transient characteristics of the provided audio object signals and tonality information that indicates the intensity of a tone component of the provided audio object signals. In addition, the object segment calculating circuit 306 may determine, as the audio characteristics, the segment position of each of the provided audio object signals, based on the tonality information that indicates the intensity of a tone component of the provided audio object signals.

The object classifying circuit 307 classifies the provided audio object signals respectively into predetermined types, according to the segment position determined (calculated) by the object segment calculating circuit 306. The object classifying circuit 307 classifies, for example, at least one of the provided audio object signals, into a first type that includes a first temporal segment and a first frequency segment as a predetermined temporal granularity and a frequency granularity. In addition, the object classifying circuit 307, for example, compares the transient information that indicates the transient characteristics of the provided audio object signals with the transient information of the audio object signal that belongs to the first type, thereby classifying the provided audio object signals into the first type and plural types different from the first type. In addition, the object classifying circuit 307, for example, classifies each of the provided audio object signals, according to the audio characteristics of the audio object signals, into one of: the first type; a second type that includes one more temporal segments or frequency segments than that of the first type; a third type that includes segments which are the same number as, but have different segment position from, the segments of the first type; and a fourth type which is different from the first type and of which the provided audio object signals do not have segments or have two segments.

The object parameter extracting circuit 308 extracts, from each of the audio object signals classified by the object classifying unit 305, object parameters (extended information), using the temporal granularity and the frequency granularity determined for each of the types.

In addition, the object parameter extracting circuit 308 codes the parameters extracted by the extracting unit. For example, the object parameter extracting circuit 308, when the parameters extracted from the audio object signals classified as the same type by the object classifying unit 305 have the same number of segments (when, for example, the audio object signals have similar transient response), codes the parameters, using the number of segments held by only one of the parameters extracted from the audio object signals, as the number of segments common to the audio object signals classified into the same type. As described above, it is also possible to reduce a code amount of the object parameters by using the same temporal segment (temporal resolution) for plural temporal segment units.

Figure 5:
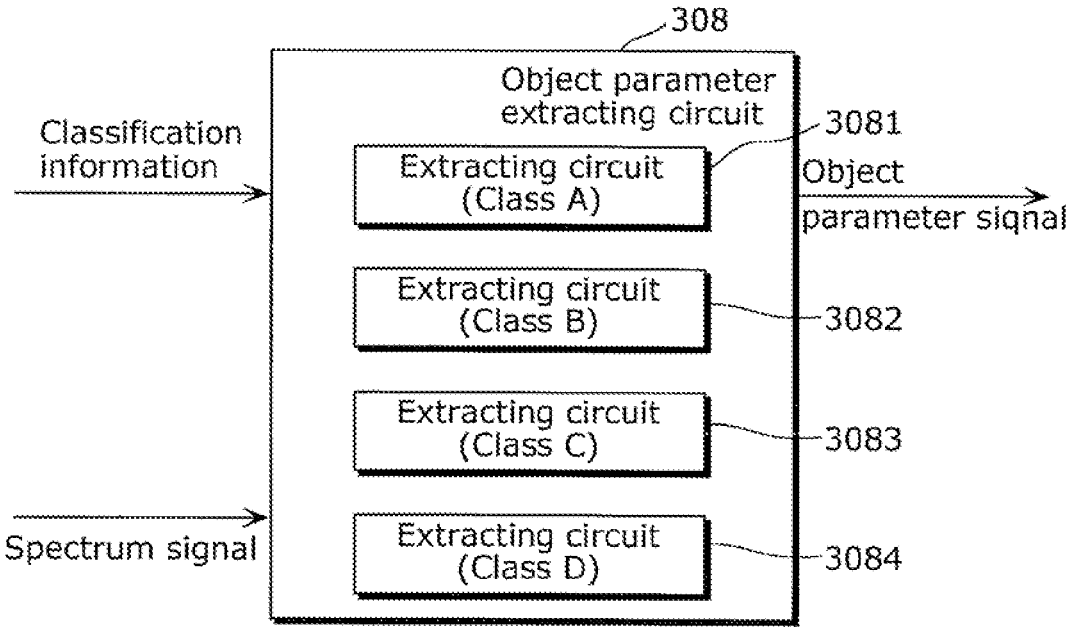
FIG. 5 is a diagram which shows an example of a detailed configuration of a object parameter extracting circuit 308.

It is to be noted that the object parameter extracting circuit 308 may include extracting circuits 3081 to 3084 each of which is provided for a corresponding one of the classes, as shown in FIG. 5. Here, FIG. 5 is a diagram which shows an example of a detailed configuration of the object parameter extracting circuit 308. FIG. 5 shows an example of the case where the classes are made up of a class A to class D. More specifically, FIG. 5 shows an example of the case where the object parameter extracting circuit 308 includes: an extracting circuit 3081 which corresponds to the class A; an extracting circuit 3082 which corresponds to the class B; an extracting circuit 3083 which corresponds to the class C; and an extracting circuit 3084 which corresponds to the class D.

Each of the extracting circuits 3081 to 3084 is provided with, based on classification information, a spectrum signal that belongs to a corresponding one of the class A, the class B, the class C, and the class D. Each of the extracting circuits 3081 to 3084 extracts object parameters from the provided spectrum signal, codes the extracted object parameters, and outputs the coded object parameters.

The multiplexing circuit 309 multiplexes the parameters extracted by the parameter extracting unit and the downmix coded signal coded by the downmix coding unit. More specifically, the multiplexing circuit 309 is provided with the object parameters from the object parameter extracting unit 304 and is provided with the downmix bitstream from the downmixing coding unit 301. The multiplexing circuit 105 multiplexes and outputs the provided downmix bitstream and the object parameters to a single audio bitstream.

The audio object decoding apparatus 300 is configured as described above.

As described above, the audio object coding apparatus 300 shown in FIG. 4 includes the object classifying unit 305 that implements a classification function that classifies audio object signals that are target of coding, into several classes (types) that have been determined in advance according to signal characteristics (audio characteristics).

The following describes in detail a method of calculating (determining) object segment information performed by the object segment calculating circuit 306.

In the present embodiment, object segment information that indicates a segment position of each of the audio signals, base on the audio characteristics, as described above.

More specifically, the object segment calculating circuit 306, based on the object signals obtained by converting audio object signals into signals in the temporal and the frequency domain by the T-F conversion circuit 303, extracts an individual object parameters (extended information) included in the audio object signals, and calculates (determines) object segment information.

For example, the object segment calculating circuit 306 determines (calculates) object segment information at the time when an audio object signal becomes a transient state, based on the transient state. Here, the fact that the audio object signal becomes the transient state means that calculation can be carried out using a transient state detection method that is generally used. More specifically, the object segment calculating circuit 360 can determine (calculate) object segment information by performing, for example, four steps described below, as a transient state detection method that is generally used.

The following is the explanation for that.

Here, the spectrum of the i-th audio object signal converted into a signal in the temporal and the frequency domain is represented as $M^i(n, k)$. In addition, an index n of the temporal segment satisfies Expression 1, an index k of a frequency subband satisfies Expression 2, and an index i of an audio object signal satisfies Expression 3.

[Math. 1]

$$0 \le n \le N-, \quad \text{(Expression 1)}$$

[Math. 2]

$$0 \le k \le K-, \quad \text{(Expression 2)}$$

[Math. 3]

$$0 \le i \le Q- \quad \text{(Expression 3)}$$

1) First, in each of the temporal segments, energy of an audio object signal is calculated using Expression 4. Here, the operator * indicates a complex conjugate.

[Math. 4]

$$E^i(n) = \sum_{k=0}^{K-1} M^i(n, k) \cdot M^{i*}(n, k) \quad \text{(Expression 4)}$$

2) Next, based on a past temporal segment calculated using Expression 4, energy of the temporal segment is smoothed using Expression 5.

[Math. 5]

$$f^i(n) = \alpha E^i(n) + (-\alpha \cdot E^i(n-) \quad \text{(Expression 5)}$$

Here, α is a smoothing parameter and a real number from 0 to 1. In addition, Expression 6 indicates energy of the i-th audio object signal in the temporal segment positioned closest to the current frame among audio frames immediately before.

[Math. 6]

$$E^i(-) \quad \text{(Expression 6)}$$

3). Next, a ratio of the energy value of the temporal segment to the smoothed energy value is calculated using Expression 7.

[Math. 7]

$$R^i(n) = E^i(n)/f^i(n) \quad \text{(Expression 7)}$$

4) Next, in the case where the above-described energy ratio is greater than a predetermined threshold T, the interval of temporal segment is judged as a transient state, and a variable Tr(n) that indicates whether or not the interval is the transient state is determined as in Expression 8 below.

[Math. 8]

$$Tr^i(n) = \begin{cases} 1 & R^i(n) > T \\ 0 & \text{otherwise} \end{cases}, \text{ for } 0 \le n \le N-, 0 \le i \le Q-. \quad \text{(Expression 8)}$$

It is to be noted that, although 2.0 is the best value as the threshold T, the threshold T is not limited to this. Ultimately, in view of the knowledge of auditory perception psychology that a rapid change in binaural cues cannot be detected by the auditory perception system of humans, the threshold is determined so as to be difficult to be auditorily perceived by humans. More specifically, the number of temporal segments in the transient state in one frame is limited to two. Then, the energy ratios $R^i(n)$ are arranged in descending order, and two temporal segments ($n^i\mathbf{1}$, $n^i\mathbf{2}$) in the most noticeable temporal segments in the transient state are extracted so as to satisfy the conditions of Expression 9 and Expression 10 indicated below.

[Math. 9]

$$n_1' - < n_2' \quad \text{(Expression 9)}$$

[Math. 10]

$$R^i(n) \leq \min(R^i(n_1^i), R^i(n_2^i)) \text{ for } 0 \leq 1 \leq V-,\ n \neq 1_1^i,\ n \neq 1_2^i. \quad \text{(Expression 10)}$$

As a result, a valid size $N_{tr}$ of the $Tr^i(n)$ is limited to Expression 11 below.

[Math. 11]

$$N_{tr}^i = \begin{cases} 0 & \text{if } Tr^i(n_1^i) + Tr^i(n_2^i) = 0 \\ 1 & \text{if } Tr^i(n_1^i) + Tr^i(n_2^i) = 1 \\ 2 & \text{if } Tr^i(n_1^i) + Tr^i(n_2^i) = 2 \end{cases} \quad \text{(Expression 11)}$$

As described above, the object segment calculating circuit 306 detects whether or not the audio object signal is in the transient state.

Then, audio object signals are classified into predetermined types (classes) based on transient information (audio characteristics of audio signals) that indicates whether or not the audio object signals are in the transient state. When the predetermined types (classes) are classes of a reference class and plural classes, for example, the audio object signals are classified into the reference class and the plural classes based on the transient information stated above.

Here, the reference class holds a referential temporal segment and position information of the temporal segment. The referential temporal segment and segment position information of the reference class are determined by the object segment calculating circuit 306 as below.

First, the referential temporal segment is determined. At this time, the calculation is carried out based on $N^i_{tr}$ described above. Then, the position information of the referential temporal segment is determined according to tonality information of the audio object signal, if necessary.

Next, each of the object signals are divided into, for example, two groups according to the size of each of transient response sets. Then, to the number of objects in each of the two groups is counted. More specifically, the values of U and V below are calculated using Expression 12.

[Math. 12]

$$U = \sum_{i=0}^{Q-1} (N_{tr}^i == 0) \text{ and } V = \sum_{i=0}^{Q-1} (N_{tr}^i == 1) \quad \text{(Expression 12)}$$

Next, the number of referential segments N is calculated from Expression 13.

[Math. 13]

$$N_{tr}^{ref} = \begin{cases} 0 & \text{if } U \geq V \\ 1 & \text{otherwise} \end{cases} \quad \text{(Expression 13)}$$

It is to be noted that, the position information of the referential temporal segment does not have to be calculated as obvious in the case of Expression 14. On the other hand, for the audio object signals having the same temporal segment, it is possible to determine the position information of the referential segment according to each of the tonalities.

[Math. 14]

$$N_{tr}^{ref} = ) \quad \text{(Expression 14)}$$

Here, the tonality indicates the intensity of a tone component included in a provided signal. Thus, the tonality is determined by measuring whether the signal component of the provided signal is a tone signal or a non-tone signal.

It is to be noted that the method of calculating a tonality is disclosed in a variety of ways in various documents. As an example, the blow algorithm is described as a tonality prediction technique.

The i-th audio object signal converted into a signal in the frequency domain is represented as $M^i(n, k)$. Here, as Expression 15, the tonality of an audio object signal is calculated as below.

[Math. 15]

$$N_{tr}^i = N_{tr}^{ref} = \quad \text{(Expression 15)}$$

1) First, cross-correlation between frames each located next to the current frame is calculated using Expression 16.

[Math. 16]

$$cor^i(k) = \frac{\left| \sum_{n=0}^{N/2-1} M^i(n, k) * M^{i*}(n + N/2, k) \right|}{\sqrt{\left( \sum_{n=0}^{N/2-1} M^i(n, k) \right|^2 ) * \left( \sum_{n=N/2}^{N-1} M^i(n, k) \right|^2 )}} \quad \text{(Expression 16)}$$

2) Next, a harmonic energy of each of the subbands is calculated using Expression 17.

[Math. 17]

$$Nrg^i(k) = \sum_{n=0}^{N-1} M^i(n, k) \Big|^2 \quad \text{(Expression 17)}$$

3) Next, a tonality of each of the parameter bands is calculated using Expression 18.

[Math. 18]

$$To^i(pb) = \frac{\sum_{k \in pb} cor^i(k) * Nrg^i(k)}{\sum_{k \in pb} Nrg^i(k)} \quad \text{(Expression 18)}$$

4) Next, a tonality of an audio object signal is calculated using Expression 19.

[Math. 19]

$$Ton^i = \max_{pb}(To^i(pb)) \quad \text{(Expression 19)}$$

The tonality of the audio object signal is predicted as described above.

In addition, an audio object signal holding a high tonality is important in present invention. Accordingly, an object signal with the highest tonality is most influential in determining a temporal segment.

Therefore, the referential temporal segment is set as the same as the temporal segment of an audio object signal with the highest tonality. In addition, in the case of plural object signals having the same tonality, an index of the smallest temporal segment is selected for the referential segment. Accordingly, Expression 20 below is satisfied.

[Math. 20]

$$P_{tr}^{ref} = \begin{cases} n & \text{if } Tr^{j}(n=1)\ \&\&\ Ton^{j} > Ton^{i} \text{ for } i \neq j \\ \min(n_1, n_2) & \text{if } Tr^{j_1}(n_1=1),\ Tr^{j_2}(n_2=1)\ \&\& \\ & Ton^{j_1} = Ton^{j_2} > Ton^{i} \text{ for } i \neq j_1,\ i \neq j_2 \end{cases} \quad \text{(Expression 20)}$$

As described above, the object segment calculating circuit 306 determines the referential temporal segment and segment position information of the reference class. It is to be noted that, the above description applies also to the case where a referential frequency segment is determined, and thus the description for that is omitted.

The following describes a process of classifying audio object signals performed by the object segment calculating circuit 306 and the object classifying circuit 307.

Figure 6:
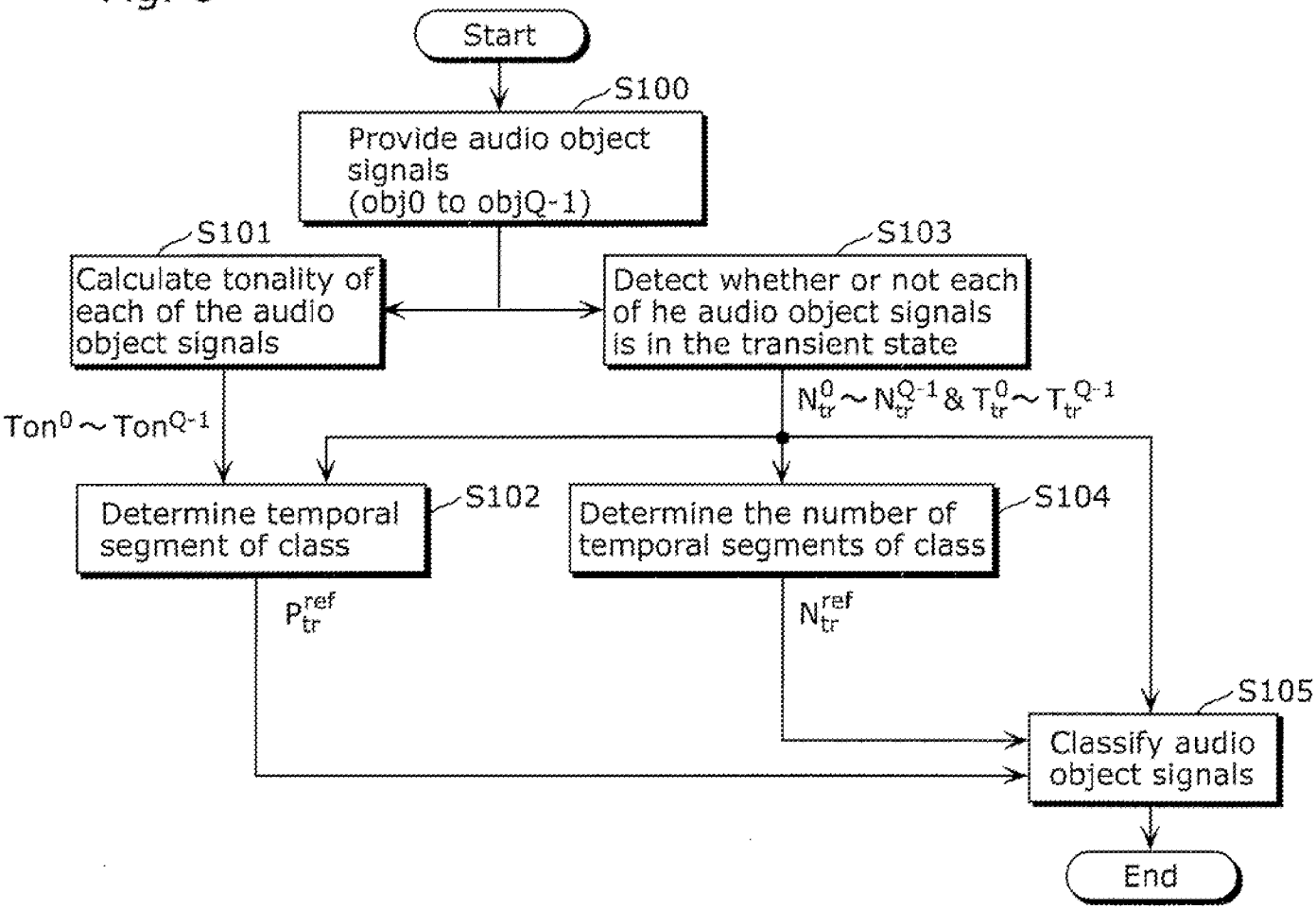
FIG. 6 is a flow chart for explaining processing of classifying an audio object signal.

FIG. 6 is a flow chart for explaining a process of classifying audio object signals.

First, audio object signals are provided into the T-F conversion circuit 303, and the audio object signals (obj0 to objQ-1, for example) converted into signals in the frequency domain by the T-F conversion circuit 303 are provided into the object segment calculating circuit 306 (S100).

Next, the object segment calculating circuit 306 calculates, as audio characteristics of the provided audio signals, a tonality ($Ton^0$ to $Ton^{Q-1}$, for example) of each of the audio object signals as explained above (S101). Next, the object segment calculating circuit 306 determines, for example, the temporal segment of the reference class and other classes using the same technique as the technique of determining the referential temporal segment described above, based on the tonality ($Ton^0$ to $Ton^{Q-1}$, for example) of each of the audio object signals (S102).

On the other hand, the object segment calculating circuit 306 detects, as the audio characteristics of the provided audio signals, the transient information that indicates whether or not the each of the audio object signals is in the transient state ($N_{tr}^0$ to $N_{tr}^{Q-1}$, $T_{tr}^0$ to $T_{tr}^{Q-1}$), as described above (5103). Next, the object segment calculating circuit 306 determines, for example, the temporal segment of the reference class and other classes, using the same technique as the technique of determining the referential temporal segment described above, based on the transient information (S102) and determines the number of the classes (S104).

Next, the object segment calculating circuit 306 calculates object segment information that indicates a segment position of each of the audio signals, base on the audio characteristics of the provided audio signals. Next, the object classifying circuit 307 classifies each of the provided audio signals into a corresponding one of the predetermined types such as the reference class and one of the other classes, using the object segment information determined (calculated) by the object segment calculating circuit 306 (S105).

As described above, the object segment calculating circuit 306 and the object classifying circuit 307 classify each of the provided audio signals into a corresponding one of the predetermined types, based on the audio characteristics of the audio signals.

It is to be noted that the object segment calculating circuit 306 determines the temporal segment of the above-described class using the transient information and the tonality as the audio characteristics of provided audio signals; however, it is not limited to this. The object segment calculating circuit 306 may use, as the audio characteristics, only the transient information or only the transient information, of each of the audio object signals. It is to be noted that the object segment calculating circuit 306 determines the temporal segment of the above-described class, using predominantly the transient information as the audio characteristics of provided audio signals, when the temporal segment of the above-described class is determined using the transient information and tonality.

According to the Embodiment 1, it is possible to implement a coding apparatus which suppress an extreme increase in a bit rate. More specifically, according to the coding apparatus of Embodiment 1, it is possible to improve the audio quality in object coding with a minimum increase in a bit rate. Therefore, it is possible to improve the degree of demultiplexing of each of the object signals.

As described above, in the audio object coding apparatus 300, provided audio object signals are calculated in two paths of the downmixing coding unit 301 and the object parameter extracting unit 304 in the same manner as the audio object coding represented by the MPEG-SAOC. More specifically, one is a path in which, for example, monaural or stereo downmix signals are generated from audio object signals and coded by the downmixing and coding unit 301. It is to be noted that, in the MPEG-SAOC technology, generated downmix signals are coded in the MPEG-AAC system. The other is a path in which object parameters are extracted from the audio object signals that have been converted into signals in the temporal and frequency domain using a QMF filter bank or the like and coded, by the object parameter extracting unit 304. It is to be noted that the method of extraction is disclosed in NPL 1 in detail.

Figure 1:
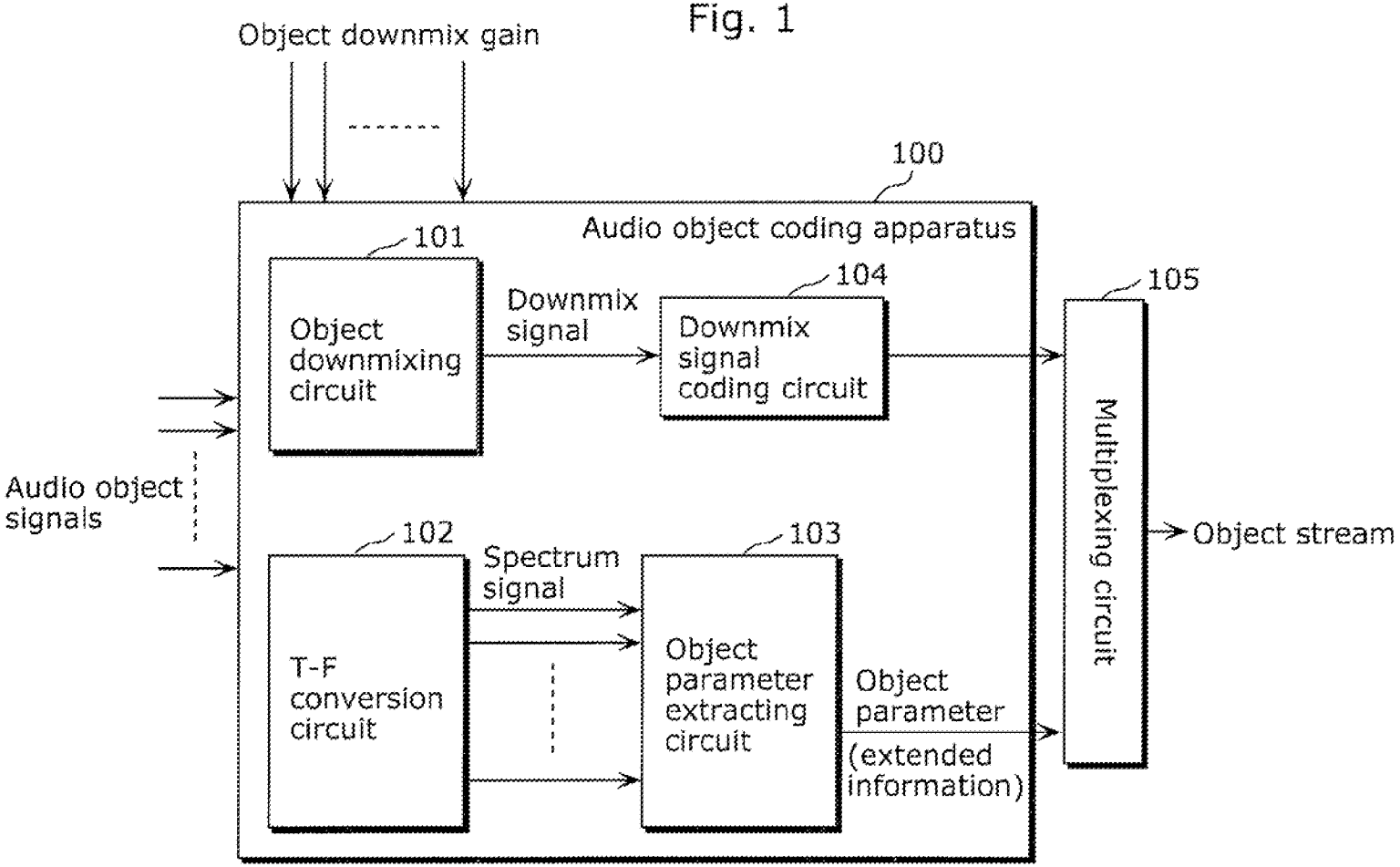
FIG. 1 is a block diagram which shows a configuration of a general audio object coding apparatus conventionally used.

In addition, when FIG. 1 and FIG. 4 are compared, the configuration of the object parameter extracting unit 304 in the audio object coding apparatus 300 is different, and in particular, they are different in that the object classifying unit 305; that is, the object segment calculating circuit 306 and the object classifying circuit 307 are included in FIG. 4. In addition, in the object parameter extracting circuit 308, the temporal segment for audio object coding is changed based on the class (predetermined types) classified by the object classifying unit 305. More specifically, compared to the conventional case where the temporal segment is adaptively changed triggered by a transitional change, the number of the temporal segments based on the number of the classes classified by the object classifying unit 305 can be suppressed, and thus coding efficiency is increased. In addition, compared to the conventional case where the number of temporal segment is zero, or one temporal segment is added to the number of temporal segments, the number of the temporal segments based on the number of the classes classified by the object classifying unit 305 larger. Thus, it is possible to more appropriately reflect the audio object signal characteristics and perform object coding with high audio quality.

Embodiment 2

In the present embodiment, classifying audio object signals into classes is the same as Embodiment 1. Other parts; that is, the differences are described in the present embodiment.

In the present embodiment, object parameters (extended information) included in an audio object signal is extracted from the audio object signal in the frequency domain based on a reference class pattern. Then, all of the provided audio object signals are classified into several classes. Here, all of the audio object signals are classified into four types of classes including the reference class, by allowing two types of the temporal segments. Here, Table 1 indicates criteria for classifying an audio object signal i.

TABLE 1

| Classification | Details of Classification | Criteria of Classification |
|---|---|---|
| A | The case where each of the audio object signals includes a temporal segment and a position of temporal segment of the pattern same as a pattern of the reference class. | $N_{tr}^{i} = V_{tr}^{ref}$ and if $N_{tr}^{ref} =$ , $Tr^{i}(P_{tr}^{ref}) =$ |
| B | The case where each of the audio object signals includes larger number of temporal segments than the number of temporal segments of the reference class. | $N_{tr}^{i} = N_{tr}^{ref} +$ |
| C | The case where each of the audio object signals includes the same number of and different position from temporal segments as the reference class. | $N_{tr}^{i} = N_{tr}^{ref} =$ and $Tr^{i}(P_{tr}^{ref}) \neq$ |
| D | The case where the reference class includes one segment and each of the audio object signals includes no temporal segment, or where the reference class includes no temporal segment and each of the audio object signals includes two temporal segments. | $N_{tr}^{i} \begin{cases} 0 & \text{if } N_{tr}^{ref} = 1 \\ 2 & \text{otherwise} \end{cases}$ |

Here, the position of temporal segments for each of the classes A to D in Table 1 is determined by tonality information of an audio object signal that is connected to the details of classification described above. It is to be noted that the same procedures is used when selecting the referential temporal segment position.

Figure 7A:
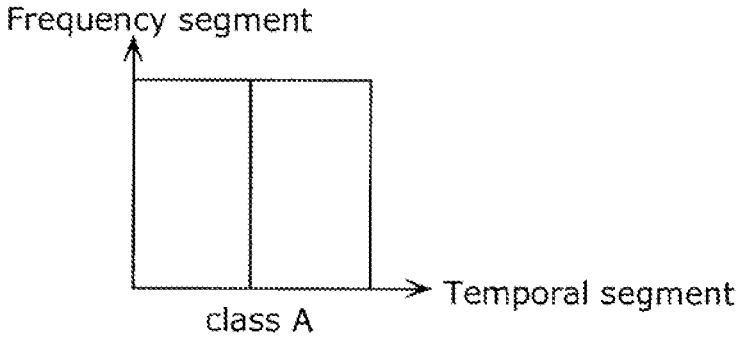
FIG. 7A shows a position of the temporal segment and the frequency segment for a class A.
Figure 7B:
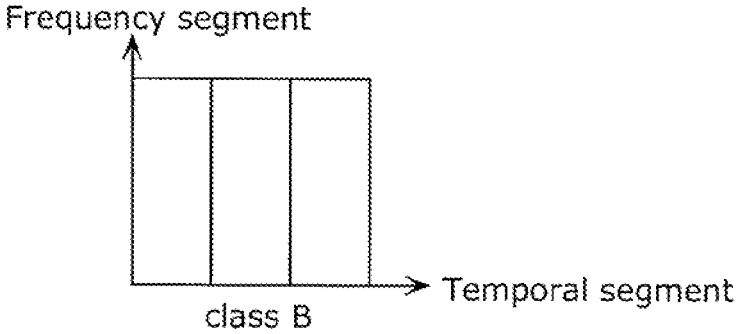
FIG. 7B shows positions of the temporal segments and the frequency segments for a class B.
Figure 7C:
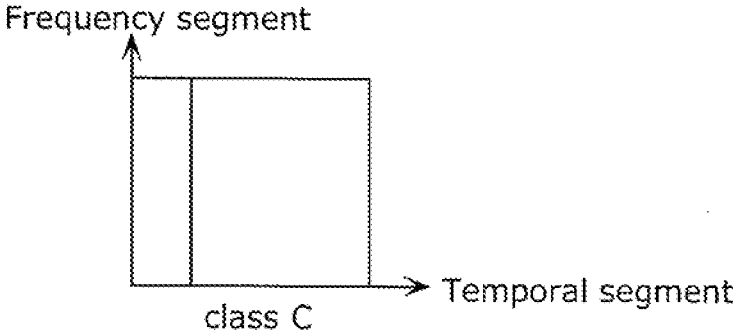
FIG. 7C shows a position of the temporal segment and the frequency segment for a class C.
Figure 7D:
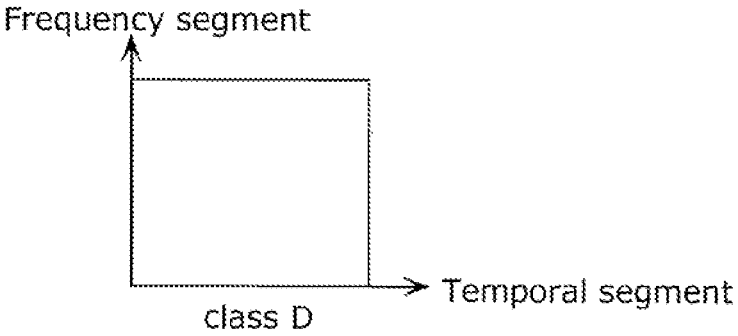
FIG. 7D shows a position of the temporal segment and the frequency segment for a class D.

For example, the position of temporal segments and frequency segments for each of the classes A to D can be illustrated as in FIG. 7A to FIG. 7D. FIG. 7A shows a position of a temporal segment and a position of frequency segment for the class A. FIG. 7B shows a position of a temporal segment and a position of frequency segment for the class B. FIG. 7C shows a position of a temporal segment and a position of frequency segment for the class C. FIG. 7D shows a position of a temporal segment and a position of frequency segment for the class D.

Once the classes; that is, the classes A to D are determined, the audio object signals share information on the same number of segments (segment number) and segment position. This is performed after an extracting process of the object parameters (extended information). Then, the common temporal segment and frequency segment are used for audio object signals classified into the same class.

In the case where all of the objects are classified into the same class, the object coding technology according to the present invention of course maintains backward compatibility with existing object coding. Unlike the general object parameter extracting technique, the extracting method according to present invention is performed based on a classified class.

In addition, object parameters (extended information) defined in the MPEG-SAOC includes various types. The following describes an object parameter improved by an extended object coding technique described above. It is to be noted that the following description is focused especially on the OLD, the IOC, and the NRG parameters.

The OLD parameter of the MPEG-SAOC is defined as in the following Expression 21 as an object power ratio for each of the temporal segment and the frequency segment of a provided audio object signal.

[Math. 21]

$$OLD^{i}(l, m) = \frac{\sum_{n \in l} \sum_{k \in m} M^{i}(n, k) \cdot M^{i*}(n, k)}{\max_{j} \left( \sum_{n \in l} \sum_{k \in m} M^{j}(n, k) \cdot M^{j*}(n, k) \right)} \quad \text{(Expression 21)}$$

$$(0 \leq l \leq L-1, \quad 0 \leq m \leq M-1.)$$

According to the object parameter extracting method based on the classified class, when the audio object signal i belongs to the class A, the OLD is calculated as in the following Expression 22 for the temporal segment or the frequency segment of the provided object signal of the class A.

[Math. 22]

$$OLD_{A}^{i}(l, m) = \frac{\left( \sum_{n \in l} \sum_{k \in m} M^{i}(n, k) \cdot M^{i*}(n, k) \right)}{\max_{j \in A} \left( \sum_{n \in l} \sum_{k \in m} M^{j}(n, k) \cdot M^{j*}(n, k) \right)} \quad \text{(Expression 22)}$$

for $i \in$ :

Other classes are also defined in the same manner.

Next, the NRG parameter of the MPEG-SAOC is described. When the NRG is calculated for an object having the largest object energy, Expression 23 is used for calculation in the MPEG-SAOC.

[Math. 23]

$$NRG(l, m) = \max_{i} \left( \sum_{n \in l} \sum_{k \in m} M^{i}(n, k) \cdot M^{i*}(n, k) \right) \quad \text{(Expression 23)}$$

According to the object parameter extracting method based on the classified class, pairs of NRG parameters are calculated using Expression 24.

[Math. 24]

$$NRG_{S}(l, m) = \max_{i \in S} \left( \sum_{n \in l} \sum_{k \in m} M^{i}(n, k) \cdot M^{i*}(n, k) \right) \quad \text{(Expression 24)}$$

Here, S indicates the class A, class B, class C, and class D in Table 1.

Next, the IOC parameter of the MPEG-SAOC is described. An original IOC parameter is calculated using Expression 25 for the temporal segment and the frequency segment of provided audio object signals.

[Math. 25]

$$IOC_{i,j}(l,m) = \mathrm{Re}\left\{\frac{\sum_{n\in l}\sum_{k\in m} M^{i}(n,k)\cdot M^{j*}(n,k)}{\sqrt{\sum_{n\in l}\sum_{k\in m} M^{i}(n,k)\cdot M^{i*}(n,k)\sum_{n\in l}\sum_{k\in m} M^{j}(n,k)\cdot M^{j*}(n,k)}}\right\} \quad \text{(Expression 25)}$$

Here, Expression 26 is satisfied.

[Math. 26]

$$0\leq, j\leq Q-, i\neq i. \quad \text{(Expression 26)}$$

According to the object parameter extracting method based on the classified class, the IOC parameters are calculated in the same manner, for the temporal segment or the frequency segment of the provided object signal from the same class. More specifically, Expression 27 is used for the calculation.

[Math. 27]

$$IOC_{i,j}(l,m) = \mathrm{Re}\left\{\frac{\sum_{n\in l}\sum_{k\in m} M^{i}(n,k)\cdot M^{j*}(n,k)}{\sqrt{\sum_{n\in l}\sum_{k\in m} M^{i}(n,k)\cdot M^{i*}(n,k)\sum_{n\in l}\sum_{k\in m} M^{j}(n,k)\cdot M^{j*}(n,k)}}\right\} \quad \text{(Expression 27)}$$

Here, Expression 28 is satisfied, and S indicates the class A, class B, class C, and class D in Table 1.

[Math. 28]

$$i,j\in, i\neq i. \quad \text{(Expression 28)}$$

It is found, from the above-described IOC calculation process, that it is not necessary to calculate the IOC parameter for a class into which only one audio object signal is classified. On the other hand, it is necessary to calculate the IOC parameter of stereo or multi-channel audio object signals classified into the same class. It is to be noted that, for a pair of audio object signals classified into classes of different types, the IOC parameter between classes are assumed to be zero in a standard status. With this, it is possible to maintain compatibility with existing object coding technique.

The following describes an object decoding method using class classification technique for classifying (hereinafter also referred to a class classification) audio object signals into plural types of classes as described above.

Two cases that depend on the status of a downmix signal; that is, the case where the downmix signal is a monaural signal and the case where the downmix signal is a stereo signal are explained.

First, the case where the downmix signal is a monaural signal is explained.

Figure 8:
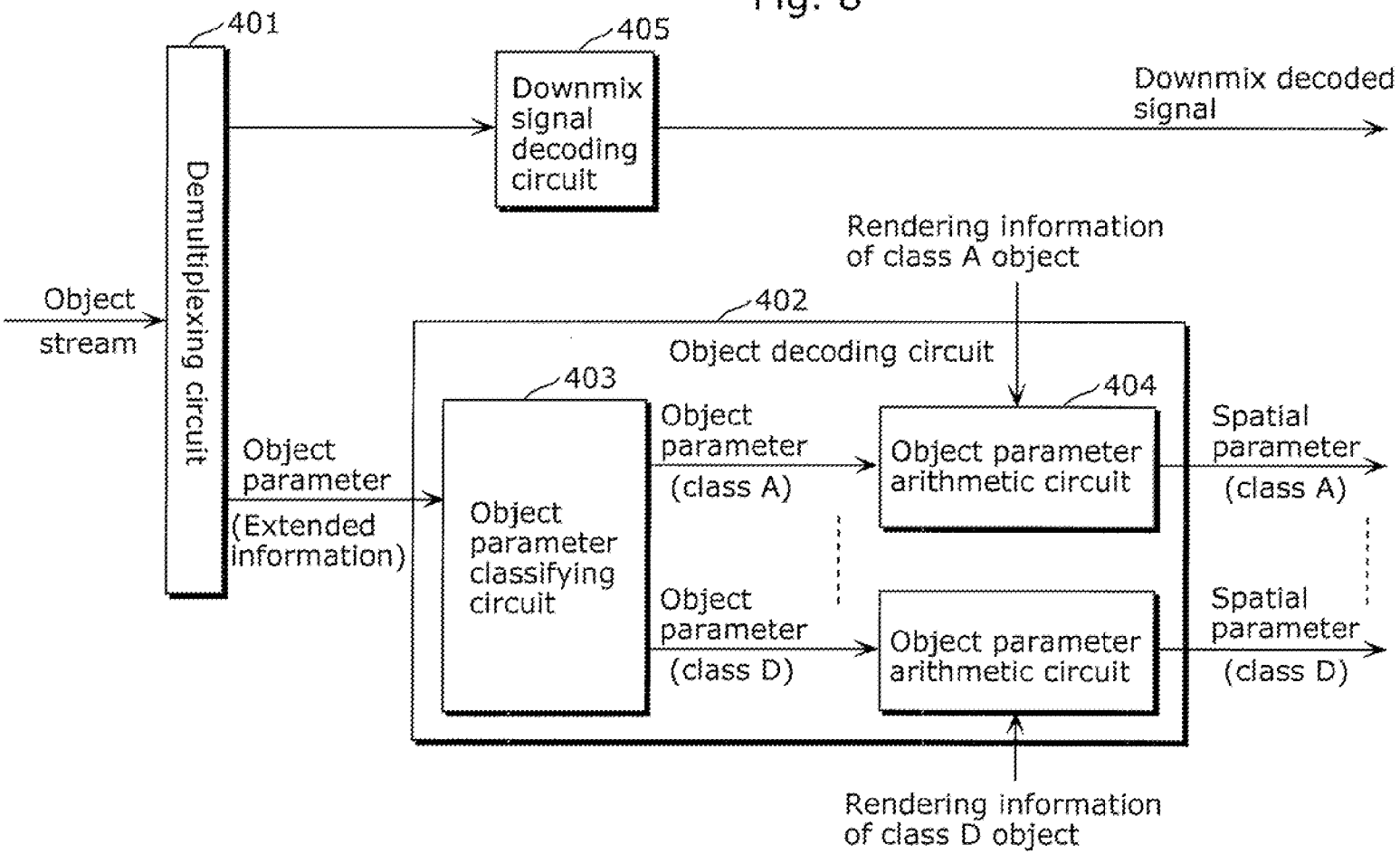
FIG. 8 is a block diagram which shows a configuration of an example of the audio object decoding apparatus according to the present invention.

FIG. 8 is a block diagram which shows a configuration of an example of the audio object decoding apparatus according to the present invention. It is to be noted that FIG. 8 shows a configuration example for an audio object decoding apparatus for a monaural downmix signal. The audio object decoding apparatus shown in FIG. 8 includes: a demultiplexing circuit 401; an object decoding circuit 402; a downmix signal decoding circuit 405.

The demultiplexing circuit 401 is provided with the object stream, that is, an audio object coded signal, and demultiplexes the provided audio object coded signal to a downmix coded signal and object parameters (extended information). The demultiplexing circuit 401 outputs the downmix coded signal and the object parameters (extended information) to the downmix signal decoding circuit 405 and the object parameter decoding circuit 402, respectively.

The downmix signal decoding circuit 405 decodes the provided downmix coded signal to a downmix decoded signal.

The object decoding circuit 402 includes an object parameter classifying circuit 403 and object parameter arithmetic circuits 404.

The object parameter classifying circuit 403 is provided with the object parameters (extended information) demultiplexed by the demultiplexing circuit 401 and classifies the provided object parameter into classes such as the class A to the class D. The object parameter classifying circuit 403 demultiplexes the object parameters based on class characteristics each associated with a corresponding one of the object parameters, and outputs to a corresponding one of the object parameter arithmetic circuits 404.

Here, as shown in FIG. 8, the object parameter arithmetic circuit 404 is configured by four processors according to the present embodiment. More specifically, when the classes are the class A to the class D, each of the object parameter arithmetic circuits 404 is provided for a corresponding one of the class A, the class B, the class C, and the class D, and object parameters that respectively belong to the class A, the class B, the class C, and the class D are provided. Then, the object parameter arithmetic circuit 404 converts object parameters that have been classified into classes and provided, into spatial parameters that have been corrected according to rendering information that has been classified into classes.

Figure 9A:
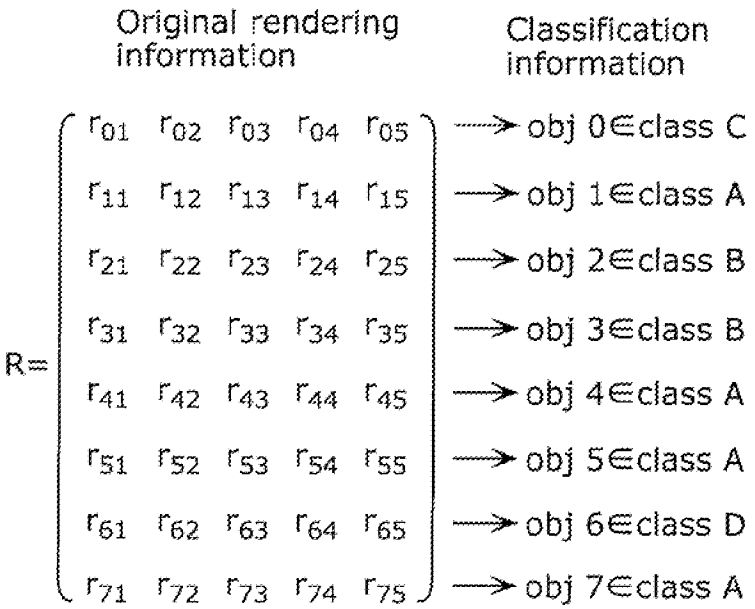
FIG. 9A is a diagram which shows a method of classifying rendering information.
Figure 9B:
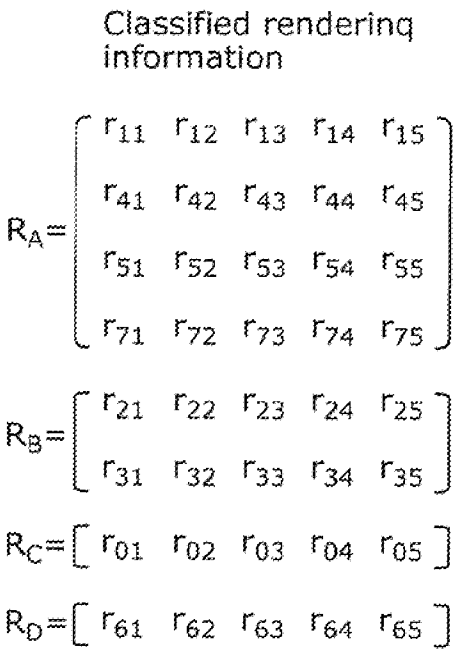
FIG. 9B is a diagram which shows a method of classifying rendering information.

It is to be noted that, in order to implement this, the original rendering information needs to be demultiplexed for each of the classes. With this, since the class information assigned to a class holds uniqueness, it becomes easy to convert into the spatial parameters, based on the information classified into classes. Here, FIG. 9A and FIG. 9B are diagrams which show a method of classifying rendering information. FIG. 9A shows rendering information obtained by classifying original rendering information into eight classes (four types of the classes of A to D), and FIG. 9B shows a rendering matrix (rendering information) at the time of outputting the original rendering information in a divided form of each of the classes of A to D. Here, each of the elements in the matrix indicates a rendering coefficient of the i-th object and the j-th output.

Figure 2:
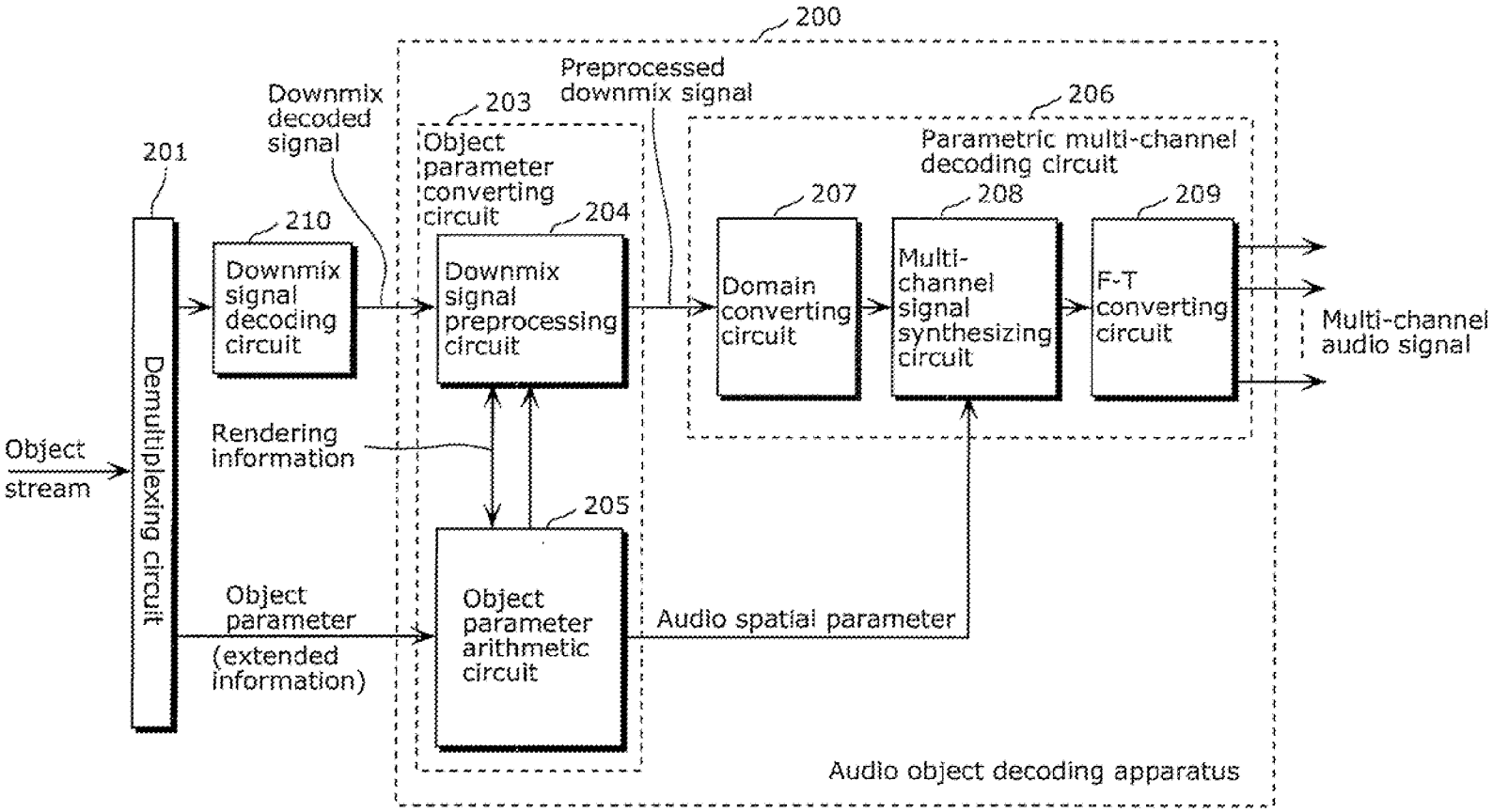
FIG. 2 is a block diagram which shows a configuration of a typical audio object decoding apparatus conventionally used.
Figure 3:
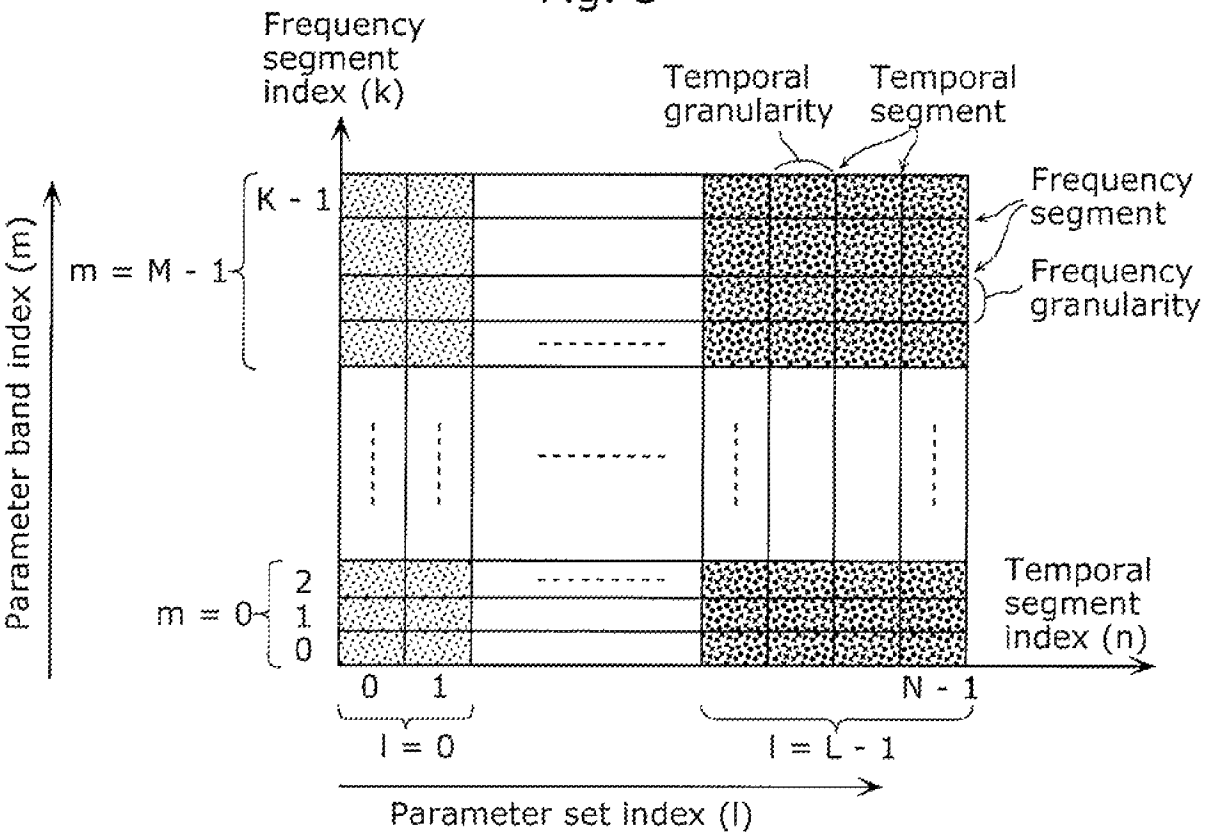
FIG. 3 shows a relationship between a temporal segment and a subband, a parameter set, and a parameter band.

The object decoding circuit 402 has a configuration extended from the object parameter arithmetic circuit 205 in FIG. 2, in which an object parameter is converted to a spatial parameter that corresponds to Spatial Cue in the MPEG surround system.

The following explains the case where a downmix signal is a stereo signal.

Figure 10:
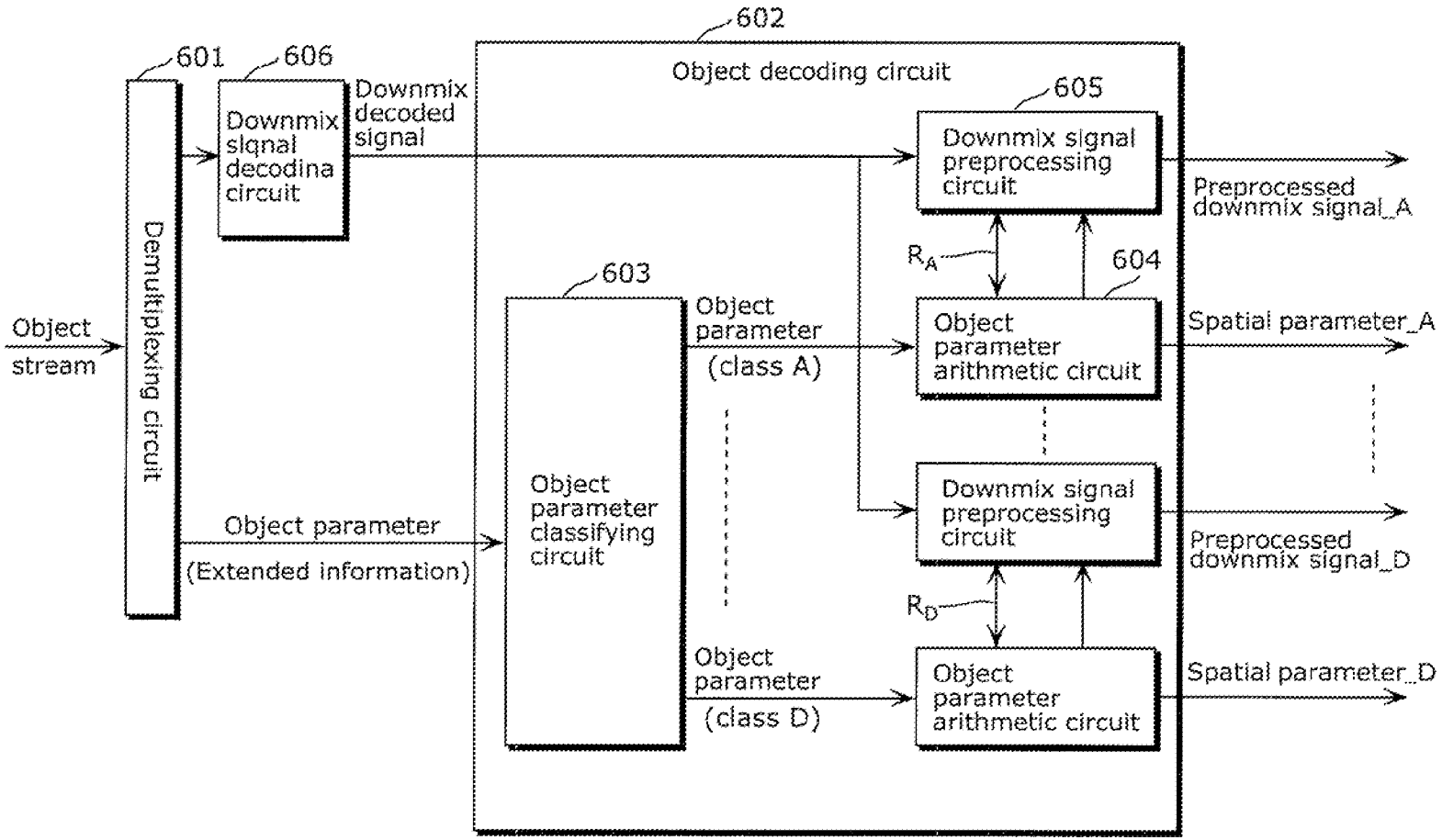
FIG. 10 is a block diagram which shows a configuration of another example of the audio object decoding apparatus according to the present invention.

FIG. 10 is a block diagram which shows a configuration of another example of the audio object decoding apparatus according to an embodiment of the present invention. It is to be noted that FIG. 10 shows a configuration example for an audio object decoding apparatus for a stereo downmix signal. The audio object decoding apparatus shown in FIG. 10 includes: a demultiplexing circuit 601; an object decoding circuit 602 based on classification; a downmix signal decoding circuit 606. In addition, the object decoding circuit 602 includes: an object parameter classifying circuit 603; object parameter arithmetic circuits 604; and downmix signal preprocessing circuits 605.

The demultiplexing circuit 601 is provided with the object stream, that is, an audio object coded signal, and demultiplexes the provided audio object coded signal to a downmix coded signal and object parameters (extended information). The demultiplexing circuit 601 outputs the downmix coded signal and the object parameters (extended information) to the downmix signal decoding circuit 606 and the object decoding circuit 602, respectively.

The downmix signal decoding circuit 606 decodes the provided downmix coded signal to a downmix decoded signal.

The object parameter classifying circuit 603 is provided with the object parameters (extended information) demultiplexed by the demultiplexing circuit 601 and classifies the provided object parameter into classes such as the class A to the class D. Then, the object parameter classifying circuit 603 outputs, to a corresponding one of the object parameter arithmetic circuits 404, each of the object parameters classified (demultiplexed) based on the class characteristics associated with each of the object parameters.

Here, in the case where the downmix signal is a stereo signal, each of the object parameter arithmetic circuits 604 and each of the downmix signal preprocessing circuits 605 is provided for a corresponding one of the classes. Then, each of the object parameter arithmetic circuits 604 and each of the downmix signal preprocessing circuits 605 performs processing based on the object parameter classified into and provided to a corresponding class and the rendering information classified into and provided to a corresponding class. As a result, the object decoding circuit 602 generates and outputs four pairs of a preprocessed downmix signal and spatial parameters.

According to the Embodiment 2 described above, it is possible to implement a coding apparatus and a decoding apparatus which suppress an extreme increase in a bit rate.

Embodiment 3

Next, in Embodiment 3, another aspect of the decoding apparatus which decodes a bitstream generated by the parametric object coding method which uses the technique of classification is described.

Figure 11:
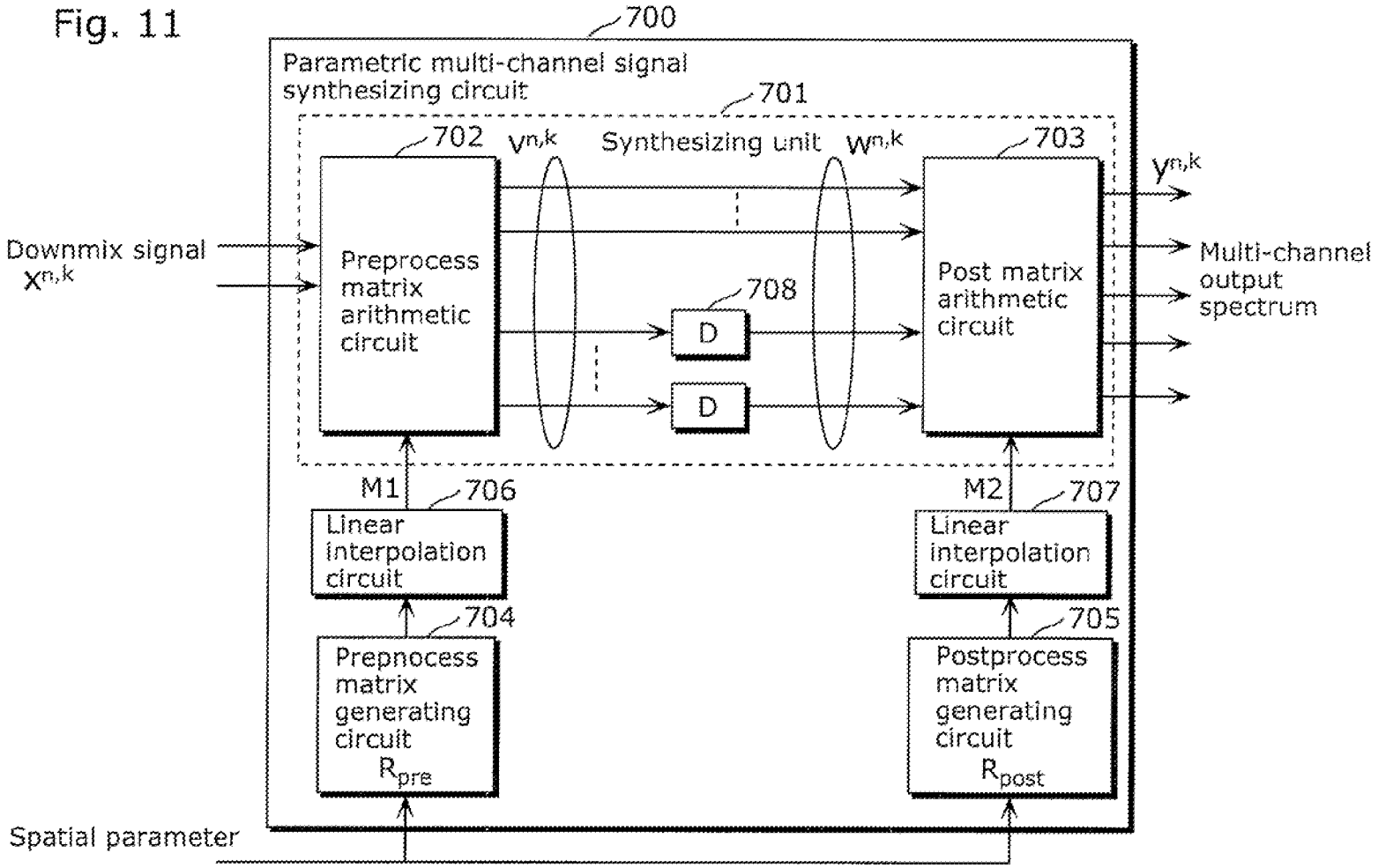
FIG. 11 is a diagram which shows a general audio object decoding apparatus.

First, a general multi-channel decoder (spatial decoder) is explained for the purpose of comparison. FIG. 11 is a diagram which shows a general audio object decoding apparatus.

The audio object decoding apparatus shown in FIG. 11 includes a parametric multi-channel decoding circuit 700. Here, the parametric multi-channel decoding circuit 700 is a module in which a core module in the multi-channel signal synthesizing circuit 208 shown in FIG. 2 is generalized.

The parametric multi-channel decoding circuit 700 includes: a preprocess matrix arithmetic circuit 702; a post matrix arithmetic circuit 703; a preprocess matrix generating circuit 704; a postprocess matrix generating circuit 705; a linear interpolation circuits 706 and 707; and a reverberation component generating circuit 708.

The preprocess matrix arithmetic circuit 702 is provided with a downmix signal (same as a preprocessed downmix signal or a synthesized spatial signal). Here, the preprocess matrix arithmetic circuit 702 corrects a gain factor so as to compensate a change in an energy value of each channel. Then, the preprocess matrix arithmetic circuit 702 provides some of outputs of prematrix ($M_{pre}$) to the reverberation component generating circuit 708 (D in the diagram) that is a decorrelator.

The reverberation component generating circuit 708 that is the decorrelator includes one or more reverberation component generating circuits each of which performs decorrelation (reverberation signal adding process) independently. It is to be noted that the reverberation component generating circuit 708 that is the decorrelator generates an output signal having no correlation with a provided signal.

The post matrix arithmetic circuit 703 is provided with: a part of the audio downmix signals whose gain factor is corrected by the preprocess matrix arithmetic circuit 702 and on which the reverberation signal adding process is performed by reverberation component generating circuit 708; and the audio downmix signals other than the audio downmix signals whose gain factor is corrected by the preprocess matrix arithmetic circuit. The post matrix arithmetic circuit 703 generates a multi-channel output spectrum using a predetermined matrix, from the part of audio downmix signals on which the reverberation signal adding process is performed by the reverberation component generating circuit 708 and the remaining audio downmix signals provided by the preprocess matrix arithmetic circuit 702. More specifically, the post matrix arithmetic circuit 703 generates the multi-channel output spectrum using a postprocess matrix ($M_{post}$). At this time, the output spectrum is generated by synthesizing a signal which is energy-compensated with a signal on which reverberation process is performed using an inter-channel correlation value (an ICC parameter in the MPEG surround).

It is to be noted that the preprocess matrix arithmetic circuit 702, the post matrix arithmetic circuit 703, and the reverberation component generating circuit 708 are included in a synthesizing unit 702.

In addition, the preprocess matrix ($M_{pre}$) and the postprocess matrix ($M_{post}$) are calculated from a transmitted spatial parameter. More specifically, the preprocess matrix ($M_{pre}$) is calculated by linearly interpolating the spatial parameters classified into types (classes) performed by the preprocess matrix generating circuit 704 and the linear interpolation circuit 706, and the postprocess matrix ($M_{post}$) is calculated by linearly interpolating the spatial parameters classified into types (classes) performed by the postprocess matrix generating circuit 705 and linear interpolation circuit 707.

The following explains a method of calculating the preprocess matrix ($M_{pre}$) and the postprocess matrix ($M_{post}$).

First, a matrix $M^{n,k}_{pre}$ and a matrix$^{n,k}_{post}$ are defined as shown in Expression 29 and Expression 30 for all of the temporal segments n and frequency subbands k in order to synthesize the matrix Mpre and the matrix Mpost, on a spectrum of a signal.

[Math. 29]

$$v^{n,k}=M_{pre}^{n,k}\cdot x^{n,k} \quad \text{(Expression 29)}$$

[Math. 30]

$$y^{n,k}=M_{post}^{n,k}\cdot w^{n,k} \quad \text{(Expression 30)}$$

In addition, the transmitted spatial parameters is defined for all of the temporal segments l and all of the parameter bands m.

Next, in the audio object decoding apparatus shown in FIG. 11, which is a spatial decoder, a synthesized matrix Rl,mpre and Rl,mpost are calculated from the preprocess matrix generating circuit 704 and the postprocess matrix generating circuit 705 based on the transmitted spatial parameters for calculating a redefined synthesized matrix.

Next, linear interpolation is performed in the linear interpolation circuit 706 and the linear interpolation circuit 707 from a parameter set (l, m) to a subband segment (n, k).

It is to be noted that the linear interpolation of the synthesized matrix is advantageous in that each temporal segment slot of the subband value can be decoded one by one without holding the subband value of all of the frames in a memory. In addition, compared to a synthesizing method based on a frame, a memory can be significantly reduced.

In the SAC technology such as the MPEG surround, for example, Mn,kpre is linear interpolated as shown in Expression 31 below.

[Math. 31]

$$M_{pre}(n,k) = \begin{cases} R_{pre}(l,m)\cdot\alpha(n,l) + (-\alpha(n,l))R_{pre}(-1,m) \\ \quad 0 \le n \le t(l),\ l = 0 \\ R_{pre}(l,m)\cdot\alpha(n,l) + (-\alpha(n,l))R_{pre}(l-1,m) \\ \quad t(l-1) < n \le t(l),\ 1 \le l < L \end{cases} \quad \text{(Expression 31)}$$

Here, Expression 32 and Expression 33 are l-th temporal segment slot index and shown as Expression 34.

[Math. 32]

$$0 \le l\pi L,\quad 0 \le k\pi K \quad \text{(Expression 32)}$$

[Math. 33]

$$t(l) \quad \text{(Expression 33)}$$

[Math. 34]

$$\alpha(n,l) = \begin{cases} \dfrac{n+1}{t(l)+1} & l = 0 \\ \dfrac{n-t(l-1)}{t(l)-t(l-1)} & \text{otherwise} \end{cases} \quad \text{(Expression 34)}$$

It is to be noted that, with the SAC decoder, the aforementioned subband k holds an unequal frequency resolution (finer resolution is held in the low frequency compared to the high frequency) and is called a hybrid band. In the object decoding apparatus using class demultiplexing according to an embodiment of the present invention, the unequal frequency resolution is used.

Figure 12:
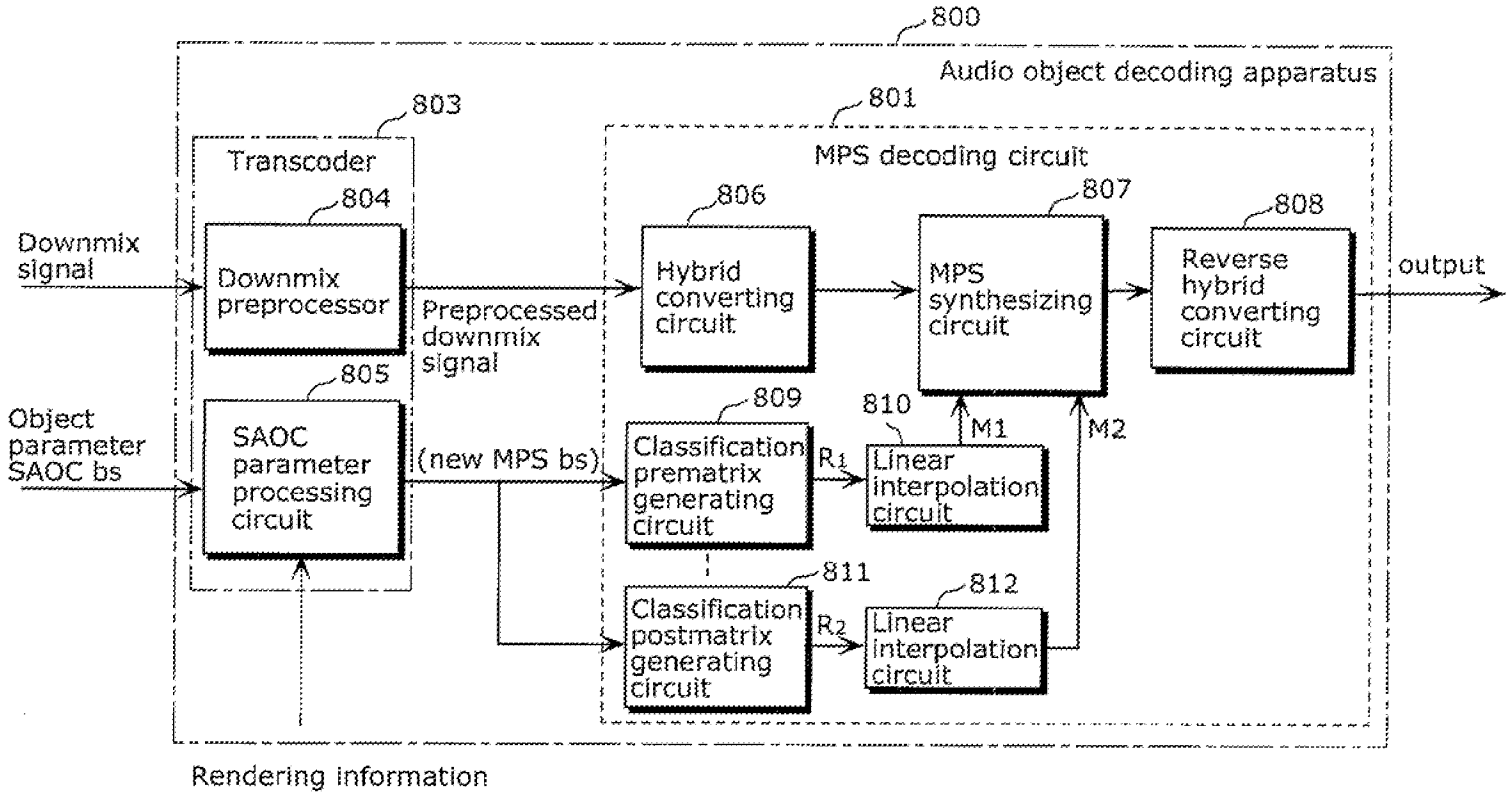
FIG. 12 is a block diagram which shows a configuration of an example of the audio object decoding apparatus according to the embodiments.

The following describes the audio object decoding apparatus according to an embodiment of the present invention. FIG. 12 is a block diagram which shows a configuration of an example of the audio object decoding apparatus according to the present embodiment.

The audio object decoding apparatus 800 shown in FIG. 12 shows an example of the case where the MPEG-SAOC technology is used. The audio object decoding apparatus 800 includes a transcoder 803 and an MPS decoding circuit 801.

The transcoder 803 includes a downmix preprocessor 804 and an SAOC parameter processing circuit 805. The downmix preprocessor 804 decodes the provided downmix coded signal to a preprocess downmix signal and outputs the decoded preprocess downmix signal to the MPS decoding circuit 801. The SAOC parameter processing circuit 805 converts the provided object parameter in the SAOC system into an object parameter in the MPEG surround system and outputs the converted object parameter to the MPS decoding circuit 801.

The MPS decoding circuit 801 includes: a hybrid converting circuit 806; an MPS synthesizing circuit 807; a reverse hybrid converting circuit 808; a classification prematrix generating circuit 809 that generates a prematrix based on a classification; a linear interpolation circuit 810 that performs linear interpolation based on the classification; a classification postmatrix generating circuit 811 that generates a postmatrix based on the classification; and a linear interpolation circuit 812 that performs linear interpolation based on the classification.

The hybrid converting circuit 806 converts the preprocessed downmix signal into a downmix signal using the unequal frequency resolution and outputs the converted downmix signal to the MPS synthesizing circuit 807.

The reverse hybrid converting circuit 808 converts a multichannel output spectrum provided from the MPS synthesizing circuit 807 using the unequal frequency resolution into an audio signal in a multi-channel temporal domain and outputs the converted audio signal.

The MPS decoding circuit 801 synthesizes the provided downmix signal into a multi-channel output spectrum and outputs to the reverse hybrid converting circuit 808. It is to be noted that the MPS decoding circuit 801 corresponds to the synthesizing unit 701 shown in FIG. 11, and thus the detailed description for the is omitted.

The audio object decoding apparatus 800 according to an aspect of the present invention is configured as described above.

As described above, the object decoding apparatus according to an aspect of the present invention performs the processes below in order to decode an object parameter on which classification object coding is performed together with a monaural or stereo downmix signal. More specifically, each of the following processes is performed: generation of a prematrix and a postmatrix based on classification; linear interpolation on the matrix (prematrix and postmatrix) based on the classification; preprocess on a downmix signal (performed only on the stereo signal) based on the classification; spatial signal synthesizing based on the classification; and finally, combining spectrum signals.

In performing the linear interpolation on a matrix based on the classification, calculation is carried out as in Expression 35 below.

[Math. 35]

$$M^S_{pre}(n,k) = \begin{cases} R^S_{pre}(l,m)\cdot\alpha(n,l) + (-\alpha(n,l))R^S_{pre}(-1,m) \\ \quad 0 \le n \le t^S(l),\ l = 0 \\ R^S_{pre}(l,m)\cdot\alpha(n,l) + (-\alpha(n,l))R^S_{pre}(l-1,m) \\ \quad t^S(l-1) < n \le t^S(l),\ 1 \le l < L \end{cases} \quad \text{(Expression 35)}$$

Here, Expression 36 and Expression 36 indicate the l-th temporal segment in the class S. Then, Expression 38 is satisfied.

[Math. 36]

$$0 \le l\pi L,\ 0 \le k\pi K \quad \text{(Expression 36)}$$

[Math. 37]

$$t^S(l) \quad \text{(Expression 37)}$$

-continued

[Math. 38]

$$\alpha(n, l) = \begin{cases} \dfrac{n+1}{t^s(l)+1} & l = 0 \\ \dfrac{n - t^s(l-1)}{t^s(l) - t^s(l-1)} & \text{otherwise} \end{cases} \quad \text{(Expression 38)}$$

Figure 13:
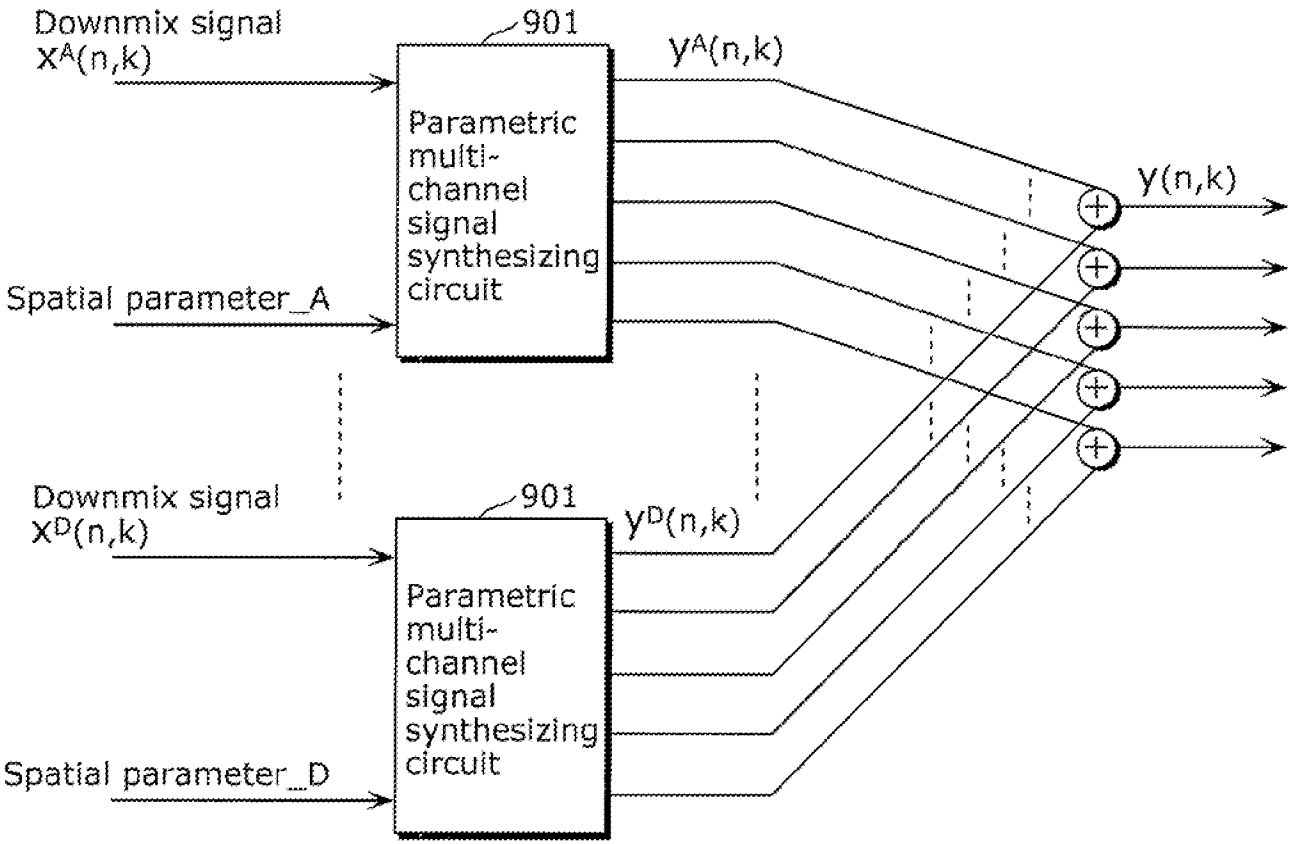
FIG. 13 is a diagram which shows an example of a core object decoding apparatus according to the present invention, for a stereo downmix signal.

Then, spatial synthesizing technique based on the classification is applied to each of the prematrix $M^S_{pre}$ and the postmatrix $M^S_{post}$ based on the classification. FIG. 13 is a diagram which shows an example of a core object decoding apparatus, for a stereo downmix signal, according to an embodiment of the present invention. Here, $X^A(n, k)$ to $X^D(n, k)$ indicate the same downmix signal in the case of a monaural signal, and indicate a classified and preprocessed downmix signal in the case of a stereo signal. In addition, each of the parametric multi-channel signal synthesizing circuits 901, which are spatial synthesizing units, corresponds to a corresponding one of the parametric multi-channel signal synthesizing circuits 700 shown in FIG. 11.

Then, each of the downmix signals based on the classification provided from a corresponding one of the parametric multi-channel signal synthesizing circuits 901 is upmixed to a multi-channel spectrum signal as in Expression 39 and Expression 40 below.

[Math. 39]

$$v^S(n,k) = M_{pre}^S(n,k) \cdot x^S(n,k) \quad \text{(Expression 39)}$$

[Math. 40]

$$y^S(n,k) = M_{post}^S(n,k) \cdot w^S(n,k) \text{ for } S = A, B, C \text{ or } D \quad \text{(Expression 40)}$$

The synthesized spectrum signal is obtained by synthesizing the spectrum signal based on the classification as in Expression 41 below.

[Math. 41]

$$y(n, k) = \sum_{S=A}^{D} y^s(n, k) \quad \text{(Expression 41)}$$

As described above, object coding and object decoding based on the classification can be performed.

It is to be noted that, in the present embodiment, the audio object decoding apparatus according to an aspect of the present invention uses four spatial synthesizing units for the classification into A to D, in order to decode the object coded signals based on the classification. This suggests that a calculation amount of the object decoding apparatus according to an aspect of the present invention increases a little, compared to the MPEG-SAOC decoding apparatus. However, a main component which requires a calculation amount is a T-F converting unit and an F-T converting unit in conventional object decoding apparatuses. In view of the above, the object decoding apparatus according to the present invention includes, ideally, the same number of T-F converting units and F-T converting units as the MPEG-SAOC decoding apparatus. Therefore, the calculation amount of the object decoding apparatus as a whole according to the present invention is almost the same as the calculation amount of the conventional MPEG-SAOC decoding apparatuses.

According to the present invention, it is possible to implement a coding apparatus and a decoding apparatus which suppress an extreme increase in a bit rate, as described above. More specifically, it is possible to improve the audio quality in object coding with only a minimum increase in a bit rate. Therefore, since the degree of demultiplexing of each of the object signals can be improved, it is possible to enhance realistic sensations in a teleconferencing system and the like when the object coding method according to present invention is used. In addition, when the object coding method according to present invention is used, it is possible to improve the audio quality of an interactive remix system.

In addition, the object coding apparatus and the object decoding apparatus according to present invention can significantly improve the audio quality compared to the object coding apparatus and the object decoding apparatus which employ the conventional MPEG-SAOC technology. In particular, it is possible to code and decode an audio object signal having a significantly large number of transient states with an appropriate bit rate and calculation amount. This is significantly beneficial for many applications which require achieving a good balance between the bit rate and the audio quality.

(Other Modifications)

It is to be noted that the object coding apparatus and the object decoding apparatus according to an implementation of present invention have been described based on the embodiments stated above; however, it is not limited to the above-mentioned embodiments. The present invention also includes the cases stated below.

(1) Each of the aforementioned apparatuses is, specifically, a computer system including: a microprocessor; a ROM; a RAM; a hard disk unit; a display unit; a keyboard; a mouse; and so on. A computer program is stored in the RAM or hard disk unit. The respective apparatuses achieve their functions through the microprocessor's operation according to the computer program. Here, the computer program is, in order to achieve a predetermined function, configured by combining plural instruction codes indicating instructions for the computer.

(2) A part or all of the constituent elements constituting the respective apparatuses may be configured from a single System-LSI (Large-Scale Integration). The System-LSI is a super-multi-function LSI manufactured by integrating constituent units on one chip, and is specifically a computer system configured by including a microprocessor, a ROM, a RAM, and so on. A computer program is stored in the RAM. The System-LSI achieves its function through the microprocessor's operation according to the computer program.

(3) A part or all of the constituent elements constituting the respective apparatuses may be configured as an IC card which can be attached and detached from the respective apparatuses or as a stand-alone module. The IC card or the module is a computer system configured from a microprocessor, a ROM, a RAM, and so on. The IC card or the module may also includes the aforementioned super-multi-function LSI. The IC card or the module achieves its function through the microprocessor's operation according to the computer program. The IC card or the module may also be implemented to be tamper-resistant.

(4) In addition, present invention may be a method described above. Furthermore, the present invention, may be a computer program for realizing the previously illustrated method, using a computer, and may also be a digital signal including the computer program.

Furthermore, the present invention may also be realized by storing the computer program or the digital signal in a computer readable recording medium such as flexible disc, a hard disk, a CD-ROM, an MO, a DVD, a DVD-ROM, a DVD-RAM, a BD (Blu-ray Disc), and a semiconductor memory.

Furthermore, the present invention also includes the digital signal recorded in these recording media.

Furthermore, the present invention may also be realized by the transmission of the aforementioned computer program or digital signal via a telecommunication line, a wireless or wired communication line, a network represented by the Internet, a data broadcast and so on.

The present invention may also be a computer system including a microprocessor and a memory, in which the memory stores the aforementioned computer program and the microprocessor operates according to the computer program.

Furthermore, by transferring the program or the digital signal by recording onto the aforementioned recording media, or by transferring the program or digital signal via the aforementioned network and the like, execution using another independent computer system is also made possible.

(5) Each of the above-mentioned embodiments and modifications may be combined with each other.

INDUSTRIAL APPLICABILITY

The present invention can be applied to a coding apparatus and a decoding apparatus which codes or decodes an audio object signal and, in particular, can be applied to a coding apparatus and a decoding apparatus applied to areas such as an interactive audio source remix system, a game apparatus, and a teleconferencing system which connects a large number of people and locations.

REFERENCE SIGNS LIST

100, 300 audio object coding apparatus
101, 302 object downmixing circuit
102, 303 T-F conversion circuit
103, 308 object parameter extracting circuit
104 downmix signal coding circuit
105, 309 multiplexing circuit
200, 800 audio object decoding apparatus
201, 401, 601 demultiplexing circuit
203 object parameter converting circuit
204, 605 downmix signal preprocessing circuit
205 object parameter arithmetic circuit
206 parametric multi-channel decoding circuit
207 domain converting circuit
208 multi-channel signal synthesizing circuit
209 F-T converting circuit
210 downmix signal decoding circuit
301 downmixing and coding unit
304 object parameter extracting circuit
305 object classifying unit
306 object segment calculating circuit
307 object classifying circuit
310 downmix signal coding circuit
402 object decoding circuit
403, 603 object parameter classifying circuit
404, 604 object parameter arithmetic circuit
405, 606 downmix signal decoding circuit
602 object decoding circuit
706 parametric multi-channel decoding circuit
701 synthesizing unit
702 preprocess matrix arithmetic circuit
703 post matrix arithmetic circuit
704 preprocess matrix generating circuit
705 postprocess matrix generating circuit
706, 707, 810, 812 linear interpolation circuit
708 reverberation component generating circuit
801 MPS decoding circuit
803 transcoder
804 downmix preprocessor
805 SAOC parameter processing circuit
806 hybrid converting circuit
807 MPS synthesizing circuit
808 reverse hybrid converting circuit
809 classification prematrix generating circuit
811 classification postmatrix generating circuit
901 parametric multi-channel signal synthesizing circuit
3081, 3082, 3083, 3084 extracting circuit

The invention claimed is:

1. A coding apparatus comprising:

a downmixing and coding unit configured to downmix audio object signals that have been provided into audio object signals having the number of channels fewer than the number of the provided audio object signals, and to code the downmix signals;

a parameter extracting unit configured to extract, from the provided audio object signals, object parameters indicating correlation between the audio object signals; and a multiplexing circuit which multiplexes the object parameters extracted by said parameter extracting unit with the downmix coded signals generated by said downmixing and coding unit, wherein said parameter extracting unit includes:

a classifying unit configured to classify each of the provided audio object signals into a corresponding one of a predetermined number of classes based on audio characteristics of each of the audio object signals, each of the predetermined number of classes indicating a predetermined temporal segment and a predetermined frequency segment; and an extracting unit configured to extract the object parameters from each of the audio object signals classified by said classifying unit using a temporal granularity and a frequency granularity which are determined for a corresponding one of the classes.

2. The coding apparatus according to claim 1, wherein said classifying unit is configured to determine the audio characteristics of the provided audio object signals using transient information indicating transient characteristics of the provided audio object signals and tonality information indicating an intensity of a tone component included in the provided audio object signals.

3. The coding apparatus according to claim 1, wherein said classifying unit is configured to classify at least one of the provided audio object signals into a first class that includes: a first temporal segment as the temporal granularity;

and a first frequency segment as the frequency granularity.

4. The coding apparatus according to claim 3, wherein said classifying unit is configured to classify the provided audio object signals, into the first class or other classes different from the first class by comparing transient information that indicates transient characteristics of the provided audio object signals with transient information of at least one of the audio object signals that belongs to the first class.

5. The coding apparatus according to claim 4, wherein said classifying unit is configured to classify each of the provided audio object signals into one of the first class, a second class, a third class, and a fourth class, according to the audio characteristics of each of the audio object signals, the second class including at least one temporal segment or frequency segment more than the first class, the third class including a temporal segment having the same number as and different in position from the first class, and the fourth class including no temporal segment when the first class includes one temporal segment or including two temporal segments when the first class includes no temporal segment.

6. The coding apparatus according to claim 1, wherein said parameter extracting unit is configured to code the object parameters extracted by said extracting unit, said multiplexing circuit multiplexes the object parameters coded by said parameter extracting unit with the downmix coded signal, and said parameter extracting unit, when the object parameters extracted from the audio object signals classified into the same class by said classifying unit have the same number of segments, is further configured to code the object parameters extracted by said extracting unit using the number of segments held by only one of the object parameters extracted from the audio object signals, as the number of segments common to the audio object signals classified into the same class.

7. The coding apparatus according to claim 1, wherein said classifying unit is configured to determine a segment position of each of the provided audio object signals based on tonality information indicating an intensity of a tone component included as the audio characteristics in each of the provided audio object signals, and to classify each of the provided audio object signals into a corresponding one of the predetermined number of classes according to the determined segment position.

8. A decoding apparatus which performs parametric multichannel decoding, said decoding apparatus comprising:

a demultiplexing unit configured to receive audio coded signals and to demultiplex the audio coded signals into downmix coded information and object parameters, the audio coded signals including the downmix coded information and the object parameters, the downmix coded information obtained by downmixing and coding audio object signals, and the object parameters indicating correlation between the audio object signals;

a downmix decoding unit configured to decode the downmix coded information to obtain audio downmix signals, the downmix coded information being demultiplexed by said demultiplexing unit;

an object decoding unit configured to convert the object parameters demultiplexed by said demultiplexing unit into spatial object parameters for demultiplexing the audio downmix signals into audio object signals; and a decoding unit configured to perform parametric multichannel decoding on the audio downmix signals into the audio object signals using the spatial object parameters converted by said object decoding unit, wherein said object decoding unit includes:

a classifying unit configured to classify each of the object parameters demultiplexed by said demultiplexing unit into a corresponding one of a predetermined number of classes, each of the predetermined number of classes indicating a predetermined temporal segment and a predetermined frequency segment; and an arithmetic unit configured to convert each of the object parameters classified by said classifying unit into a corresponding one of the spatial object parameters classified into the classes.

9. The decoding apparatus according to claim 8, further comprising a preprocessing unit configured to preprocess the downmix coded information, said preprocessing unit being provided in a stage prior to said decoding unit, wherein said arithmetic unit is configured to convert each of the object parameters classified by said classifying unit into a corresponding one of the spatial object parameters classified into the classes based on spatial arrangement information classified based on the predetermined number of classes, and said preprocessing unit is configured to preprocess the downmix coded information based on each of the classified object parameters and the classified spatial arrangement information.

10. The decoding apparatus according to claim 9, wherein the spatial arrangement information indicates information on a spatial arrangement of the audio object signals and is associated with the audio object signals, and the spatial arrangement information classified based on the predetermined number of classes is associated with the audio object signals classified into the predetermined number of classes.

11. The decoding apparatus according to claim 8, wherein said decoding unit includes:

a synthesizing unit configured to synthesize the audio downmix signals into spectrum signal sequences classified into the classes according to the spatial object parameters classified into the classes;

a combining unit configured to combine the classified spectrum signals into a single spectrum signal sequence; and a converting unit configured to convert the spectrum signal sequence into audio object signals, the spectrum signal sequence being obtained by combining the classified spectrum signals.

12. The decoding apparatus according to claim 11, further comprising an audio object signal synthesizing unit configured to synthesize multi-channel output spectrums from the provided audio downmix signals, wherein said audio object signal synthesizing unit includes:

a preprocess sequence arithmetic unit configured to correct a gain factor of the provided audio downmix signals, a preprocess multiplying unit configured to linearly interpolate the spatial object parameters classified into the classes and to output the linearly interpolated spatial object parameters to said preprocess sequence arithmetic unit;

a reverberation generating unit configured to perform a reverberation signal adding process on a part of the audio downmix signals whose gain factor is corrected by said preprocess sequence arithmetic unit; and a postprocess sequence arithmetic unit configured to generate the multi-channel output spectrums using a predetermined sequence from the part of the audio downmix signals which is corrected and on which reverberation signal adding process is performed by said reverberation generating unit and a rest of the corrected audio downmix signals provided from said preprocess sequence arithmetic unit.

13. A coding method comprising:

downmixing audio object signals that have been provided into audio object signals having the number of channels fewer than the number of the provided audio object signals, and coding the downmix signals;

extracting object parameters from the provided audio object signals, the object parameters indicating correlation between the audio object signals; and multiplexing the object parameters extracted in said extracting of object parameters with the downmix coded signals coded in said downmixing and coding, wherein said extracting of object parameters includes classifying each of the provided audio object signals into a corresponding one of a predetermined number of classes based on audio characteristics of each of the audio object signals, each of the predetermined number of classes indicating a predetermined temporal segment and a predetermined frequency segment, and extracting the object parameters from each of the audio object signals classified in said classifying using a temporal granularity and a frequency granularity which are determined for a corresponding one of the classes.

14. A non-transitory computer-readable recording medium for use in a computer, the recording medium having a computer program recorded thereon for causing the computer to execute:

downmixing audio object signals that have been provided into audio object signals having the number of channels fewer than the number of the provided audio object signals, and coding the downmix signals;

extracting object parameters from the provided audio object signals, the object parameters indicating correlation between the audio object signals; and multiplexing the object parameters extracted in said extracting of object parameters with the downmix coded signals coded in said downmixing and coding, wherein said extracting of object parameters includes classifying each of the provided audio object signals into a corresponding one of a predetermined number of classes based on audio characteristics of each of the audio object signals, each of the predetermined number of classes indicating a predetermined temporal segment and a predetermined frequency segment, and extracting the object parameters from each of the audio object signals classified in said classifying using a temporal granularity and a frequency granularity which are determined for a corresponding one of the classes.

15. A semiconductor integrated circuit comprising:

a downmixing and coding circuit which downmixes audio object signals that have been provided into audio object signals having the number of channels fewer than the number of the provided audio object signals, and to code the downmix signals;

a parameter extracting circuit which extracts, from the provided audio object signals, object parameters indicating correlation between the audio object signals; and a multiplexing circuit which multiplexes the object parameters extracted by said parameter extracting circuit and the downmix coded signals generated by said downmixing and coding circuit, wherein said parameter extracting circuit includes:

a classifying circuit which classifies each of the provided audio object signals into a corresponding one of a predetermined number of classes based on audio characteristics of each of the audio object signals, each of the predetermined number of classes indicating a predetermined temporal segment and a predetermined frequency segment; and an extracting circuit which extracts the object parameters from each of the audio object signals classified by said classifying circuit using a temporal granularity and a frequency granularity which are determined for a corresponding one of the classes.

* * * * *